US009719749B1

(12) United States Patent
Prior

(10) Patent No.: US 9,719,749 B1
(45) Date of Patent: Aug. 1, 2017

(54) PROJECTILE LAUNCHER

(71) Applicant: Michael W. Prior, Silver Spring, MD (US)

(72) Inventor: Michael W. Prior, Silver Spring, MD (US)

( * ) Notice: Subject to any disclaimer, the term of this patent is extended or adjusted under 35 U.S.C. 154(b) by 0 days.

(21) Appl. No.: 15/214,417

(22) Filed: Jul. 19, 2016

(51) Int. Cl.

| | |
|---|---|
| ***F41B 7/04*** | (2006.01) |
| ***F41B 5/00*** | (2006.01) |
| ***F41B 7/00*** | (2006.01) |
| ***F41B 3/00*** | (2006.01) |
| ***F41B 5/12*** | (2006.01) |

(52) U.S. Cl.
CPC ..... *F41B 5/0094* (2013.01); *F41B 3/005* (2013.01); *F41B 5/12* (2013.01); *F41B 7/003* (2013.01)

(58) Field of Classification Search
CPC .... F41B 3/005; F41B 5/10; F41B 5/12; F41B 7/003; F41B 7/04
See application file for complete search history.

(56) References Cited

U.S. PATENT DOCUMENTS

| | | | | |
|---|---|---|---|---|
| 3,509,863 | A | 5/1970 | Barker | |
| 3,968,783 | A | 7/1976 | Pfotenhauer | |
| 4,169,456 | A | 10/1979 | Van House | |
| 5,355,866 | A | 10/1994 | Hunter | |
| 6,273,078 | B1 | 8/2001 | Schwesinger | |
| 7,743,760 | B2 | 6/2010 | Woodland | |
| 7,836,871 | B2 | 11/2010 | Kempf | |
| 7,926,474 | B2 | 4/2011 | Berry | |
| 7,997,258 | B2 | 8/2011 | Shepley et al. | |
| 8,485,170 | B1 * | 7/2013 | Prior | F41B 5/0094 124/25 |
| 2013/0213372 | A1 | 8/2013 | Biafore et al. | |
| 2014/0069400 | A1 | 3/2014 | Nebergall | |
| 2014/0261358 | A1 | 9/2014 | Pulkrabek et al. | |

* cited by examiner

*Primary Examiner* — John Ricci
(74) *Attorney, Agent, or Firm* — Richard C. Litman

(57) ABSTRACT

The projectile launcher includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking carriage riding inside a rail system in the barrel assembly. The cocking carriage selectively engages a projectile nock carriage riding within the rail system to push the nock carriage into a cocked position. The internal bow assembly includes vertically spaced upper and lower resilient bow arms and a system of pulleys and cables interconnecting the bow arms and the nock carriage. Cocking to the nock carriage flexes the bow arms in preparation for placement and firing of a projectile. The working components of the projectile launcher are enclosed by a covering to protect the user.

18 Claims, 15 Drawing Sheets

PROJECTILE LAUNCHER

BACKGROUND OF THE INVENTION

1. Field of the Invention

The present invention relates to archery weapons, and particularly to a projectile launcher provided with covered, internalized bow elements and corresponding cocking mechanism for increased balance, safe handling, and minimized effort in operation.

2. Description of the Related Art

Crossbows have long been known in the art. The traditional design dates back to the 14th century or earlier, when very high powered crossbows were effective, especially against armored horsemen. A large medieval crossbow of circa 1500 A.D. might have a draw weight of 1200 pounds and a range of 450 yards. In modern times, crossbows rarely exceed 200 pounds draw weight. Modern crossbows now use sighting mechanisms of various sorts, advanced composite materials and metal alloys, wheel/pulley systems, etc., but otherwise are little changed, except in style and construction materials. Draw weights are dramatically lower, which are tailored to target shooting or hunting applications, rather than warfare.

Crossbows normally use rifle-style stocks. Indeed, the modern rifle design originated with the medieval crossbow. Sights may be aperture sights, as found on a rifle; pin sights, as on a compound longbow; or telescopic sights. A modern 200 pound draw weight heavyweight crossbow will achieve similar projectile speeds to a 60 pound peak draw weight compound hand bow, and the bolt and arrow weights are also similar (300-400 grains).

The crossbow, being relatively short as compared to recurve bows and the like, requires comparatively more force to bend. Most crossbows must be cocked by using the feet and legs or a mechanical aid for very powerful bows. Because of the large amount of force applied and mechanical energy stored and released, significant safety concerns exist due to the structure of a conventional crossbow.

The bowstring sweeps along the top of the bow, and it is external. The bow limbs extend out to the sides of the crossbow and sweep forward when fired. The bolt travels openly exposed down the rail at high speeds when fired. Consequently, the user must exercise caution when cocking and uncocking, handling a cocked bow (whether loaded or unloaded), and firing to avoid inadvertent bodily contact with high energy and sharpened bow components. For example, the user must always take into account the sweep of the limbs when firing to prevent limb contact with external objects, which can cause significant back force into the stock and ultimately to the user's body (often the facial area). The user must avoid putting fingers/hands between the cocked bow and the bowstring.

The traditional crossbow, with its exposed mechanism and bowstring cocking mechanism, is not a compact design, which presents some ease of use concerns when applied to hunting applications as compared to a firearm/gun, and even the typical longbows and the like. The large cross-sectional area created by the bow limbs being mounted transverse to the stock can result in frequent snagging with tree limbs and foliage when being transported in the field. Mitigating the safety concerns described above often results in limited shooting angles when hunting in close proximity to trees due to the need for accommodating a "safe zone" around the bow limbs. The use of external (to the bow) cocking mechanisms that must be attached to the bow each time it is cocked or uncocked and that rely upon the physical strength of the user to perform these actions can often result in cumbersome and strenuous manipulations of the bow and associated equipment in a hunting scenario due to limited space.

The use of the cross-mounted bow and string also introduce potential shooting inaccuracy. Unless the bow is exactly evenly cocked such that the bowstring center point is being held by the trigger mechanism, side forces will be imparted on the bolt during acceleration down the rail, which will adversely affect its flight accuracy. Cocking the bow even 1/16" off center will drastically change the bolt's point of impact.

Accurate aiming with crossbows is also adversely affected by their typical design. The conventional crossbow has an imbalanced weight distribution, which places the center of mass far forward of the weapon, due to the bow limbs and associated mounting placed at the distal end of the rail or table. Thus, the user must compensate and support the weighty forward end with more strength and care during aiming compared to typical firearms, such as rifles or the conventional recurve bow. One attempt to address this issue places the mounting hardware near the rear of the elongate table, and the bow limbs are mounted in reverse orientation from traditional, i.e., the arch of the bow faces the user instead of away from the user. This type of crossbow may provide better balance, but it still experiences the same type of concerns mentioned above, i.e., safety and the need to accommodate the cross-extending bow limbs during use.

Another concern of traditional crossbow designs arises from the results of a completed shot. The sudden dissipation of energy at the end of a shot through various components of the crossbow can cause excessive vibration in the bowstring, resulting in noise akin to a plucked guitar string. Since hunting requires a degree of stealth, anything compromising this aspect, such as the noise from a loosed bowstring, is highly undesirable. One solution includes dampener accessories mounted to the bowstring or bow assembly. While such accessories may assist in reducing the vibrations, they are one of many accessories that the user must consider. Depending on the size and complexity of such dampeners, they can negatively impact mobility and the space required for hunting, as well as projectile performance.

Several solutions have been proposed in my previous U.S. Pat. Nos. 8,486,170, 8,863,732, and 9,052,154, which are all hereby incorporated by reference in their entirety. The projectile launchers taught by these references eliminate or substantially reduce some of the known issues of conventional crossbows by providing a cross-bow type weapon that is balanced, safe handling, and easy and quiet to operate for increased convenience and stealth. There is still a need in the art of archery weapons, however, to provide a crossbow-type weapon that is relatively less complex and more energy efficient. Thus, a projectile launcher solving the aforementioned problems is desired.

SUMMARY OF THE INVENTION

The projectile launcher includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking carriage riding inside a rail system in the barrel assembly. The cocking carriage selectively engages a projectile nock carriage riding within the rail system to push the nock carriage into a cocked position. The internal bow assembly includes vertically spaced upper and lower resilient bow arms and a system of pulleys and cables interconnecting the bow arms and the nock carriage. Cocking the nock carriage flexes the bow arms in preparation for placement and firing of a projectile. The working components of the projectile launcher are enclosed by a covering to protect the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
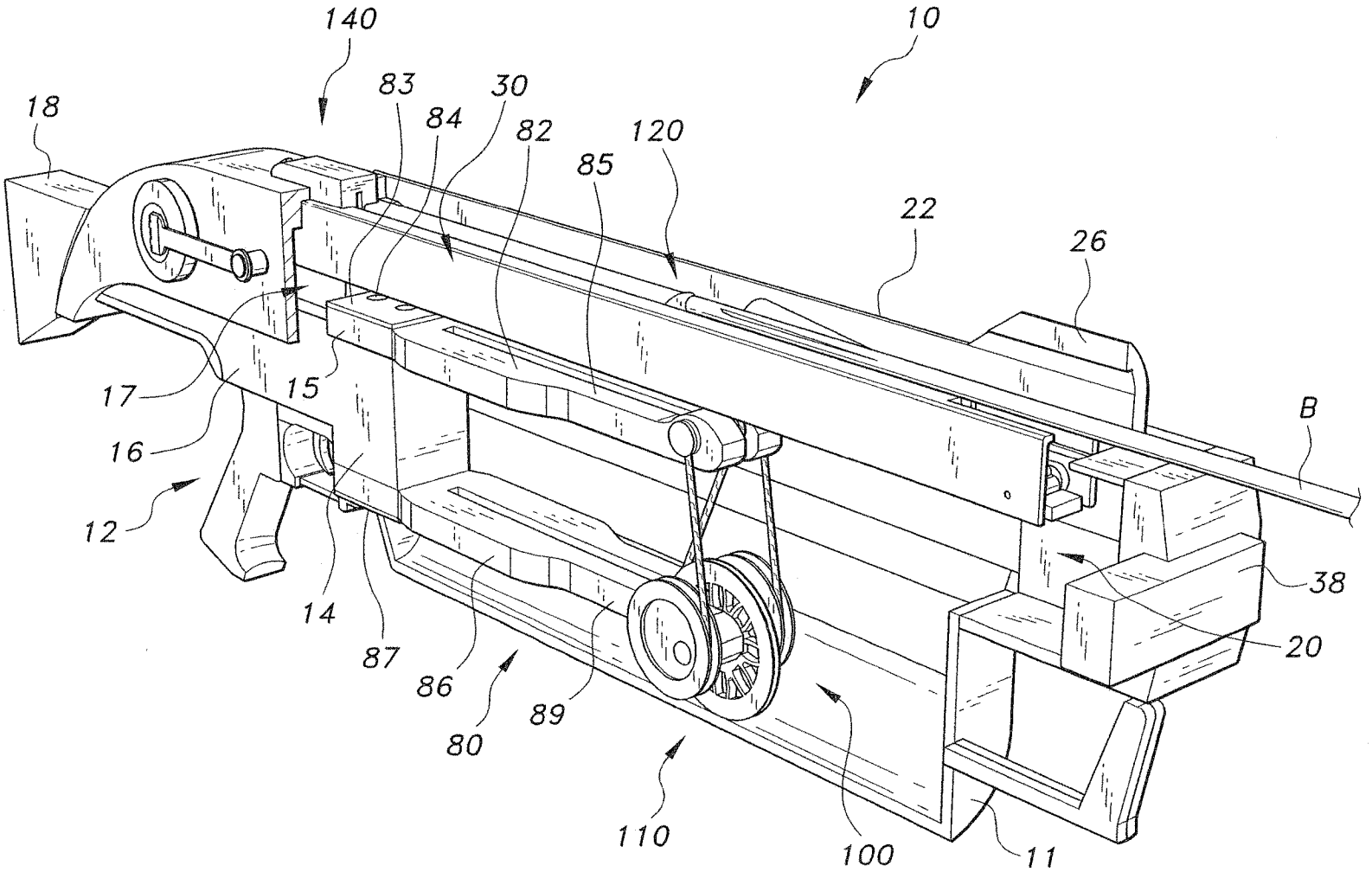
FIG. 1 is perspective view of a first embodiment of a projectile launcher according to the present invention, shown with part of the side panel removed for clarity.
Figure 2:
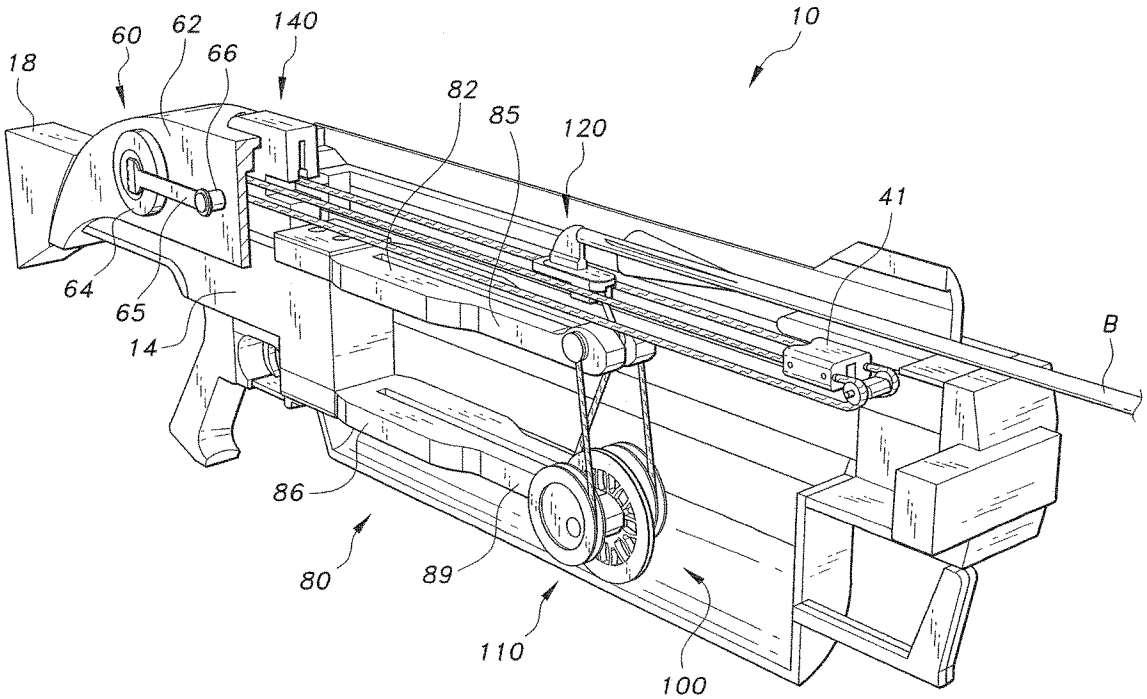
FIG. 2 is a perspective view of the projectile launcher of FIG. 1, shown with the rail system removed to show additional details.

The projectile launcher, a first embodiment of which is generally referred to by the reference number 10, provides a well-balanced and enhanced safe-handling/firing archery-type weapon in a relatively compact, simple, and energy-efficient form. The term "projectile launcher," as used herein, refers to a device capable of launching various types of elongate projectiles B, such as crossbow bolts, arrows, stakes, etc., that may be provided with either blunt or sharpened tips. As shown in FIGS. 1 and 2, the projectile launcher 10 includes a riser base 12 where the rest of the components of the projectile launcher 10 are mounted or attached. The riser base 12 is a substantially L-shaped block having a vertical short section 14 and an integral long section 16 extending transversely from an end of the short section 14. A portion of the long section 16 that meets with the short section 14 may be notched, forming a mounting ledge 15 for mounting one of the bow limbs, the details of which will be further described below. The riser base 12 is preferably constructed from relatively lightweight, yet strong, durable material, such as aluminum, but other similar metals, wood, composites, and combinations thereof can also be used. The short section 14 is preferably solid, since this portion experiences the most stress, while the long section 16 includes an elongate slot 17 for passage of a trigger mechanism 140, to be described below. To reduce weight, portions of the short section 14 can be removed without adversely affecting the structural integrity, performance and function of this component. A stock 18 is detachably mounted to the distal end of the long section 16.

An elongate barrel assembly 20 is disposed along the top length of the long section 16. The barrel assembly 20 includes a pair of elongate side panels 22 attached to sides of a rail system 30 disposed between the side panels 22. FIGS. 1 and 2 show only one side panel 22 because the other has been removed to show the internal components of the projectile launcher 10. The rail system 30 facilitates cocking and loosing of a projectile B, such as a crossbow bolt. The side panels 22 are preferably elongate, rectangular plates having a height extending above the top surface of the rail system 30, thereby serving as side guards. Additionally, each side panel 22 includes respective upwardly extending curved projections 26 at the distal end. Each projection 26 curves inwardly towards the central rail system 30, partially covering that end of the barrel assembly 20. These curved projections 26 also serve as protective guards, providing limited cover over the sharp tip of the projectile B when cocked. Moreover, they can also serve as a crude, integral sight, similar to the aperture sights on typical firearms.]

Figure 5:
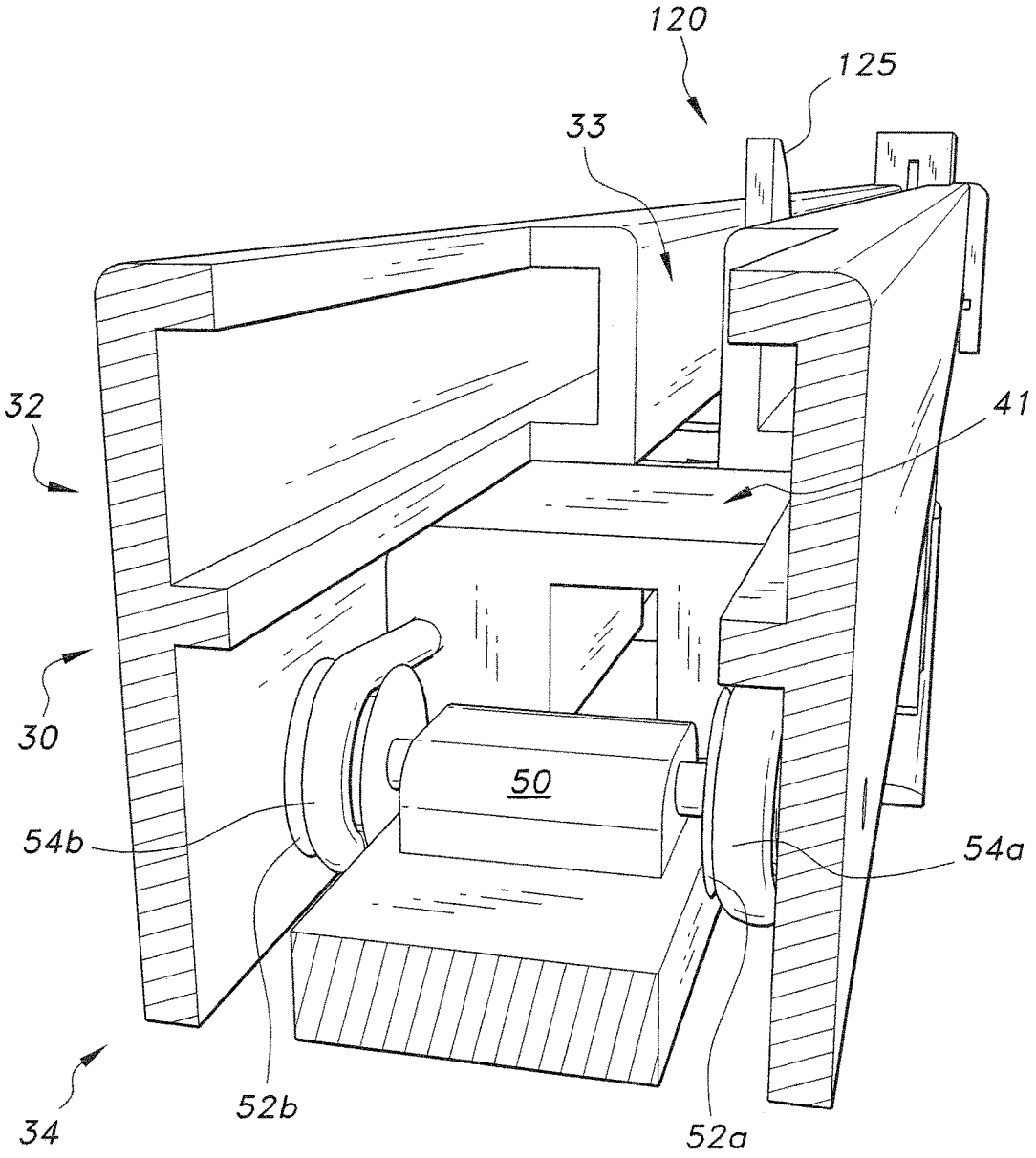
FIG. 5 is a front perspective view of the rail system for the projectile launcher of FIG. 1.
Figure 6:
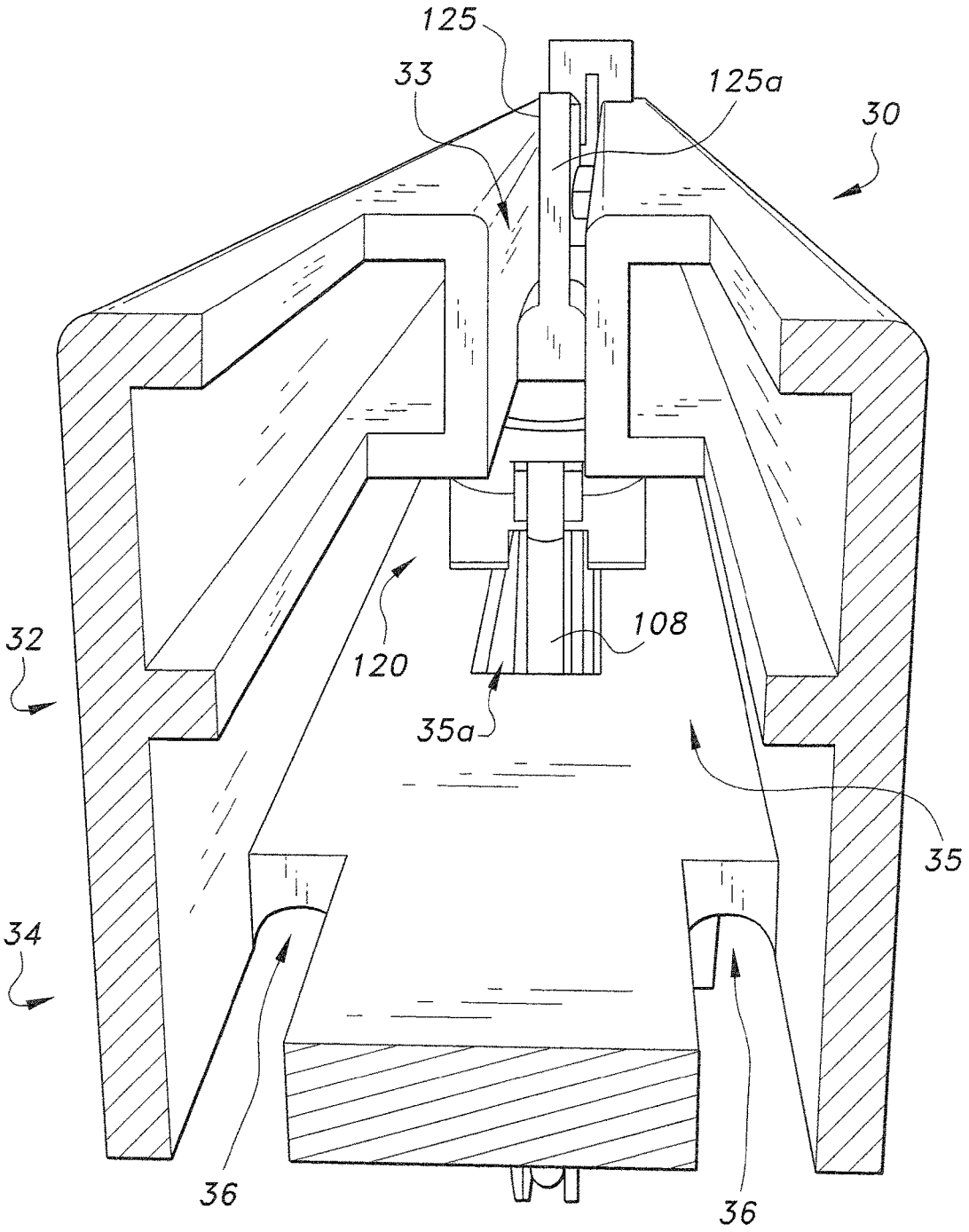
FIG. 6 is a front perspective view of the rail system of FIG. 5, shown with the first idler mounting block and the cocking carriage removed.

As best seen in FIGS. 1, 5, and 6, the rail system 30 includes an elongate, upper rail section 32 and an elongate lower rail section 34. The front or distal end of the rail system 30 can be provided with one or more resilient bumpers 38 to protectively support the front of the projectile launcher 10 during the cocking operation while the projectile launcher 10 is braced at its distal end against another object or the ground. The upper rail section 32 slidably supports a projectile nock carriage 120 for the projectile B, while the lower rail section 34 slidably supports a cocking carriage 41 for cocking the projectile launcher 10. The rail sections 32, 34 are preferably constructed as an elongate, integral rectangular tube, forming various channels or slots therein. An elongate, vertical slot 33 is formed along the upper rail section 32 and serves as a flight groove for the projectile B. The slot 33 widens at the distal end of the upper rail section 32 in order to accommodate the head or tip of the projectile B. Although the widened section of the slot 33 is shown as a square or rectangular cutout, this section can be of any shape capable of permitting the tip of the projectile B to rest therein. The slot 33 also facilitates operation of a component of the cocking mechanism 40, which will be further described below.

The slot 33 preferably extends the whole length of the upper rail section 32. Alternatively, the extension of the slot 33 can stop short near the proximal end of the rail section 32.

Any slot length can serve, so long as it provides proper support for the projectile B and permits operation of the cocking mechanism 40.

As best seen in FIGS. 5 and 6, the interior edge of the slot 33 is preferably smooth and rounded to prevent any increased frictional engagement of the shaft when the projectile B is loosed. A non-smooth edge can potentially snag on the projectile 13, reducing much of the energy imparted for flight. In the same vein, the surfaces of the slot 33 and/or the top surface of the upper rail section 32 can also be provided with a coating or a layer of friction-reducing material, such as Teflon® (Teflon is a registered trademark of E.I. Du Pont de Nemours and Company of Wilmington, Del.) and the like, in order to maximize the kinetic energy of the projectile B.

The top panel or portion of the lower rail section 34 also includes an elongate, horizontal slot 35 contiguous and extending parallel with the slot 33. The hollow interior of the lower rail section 34 accommodates slidable movements of the cocking carriage 41 to selectively engage the projectile nock carriage 120 during the cocking operation.

Figure 3:
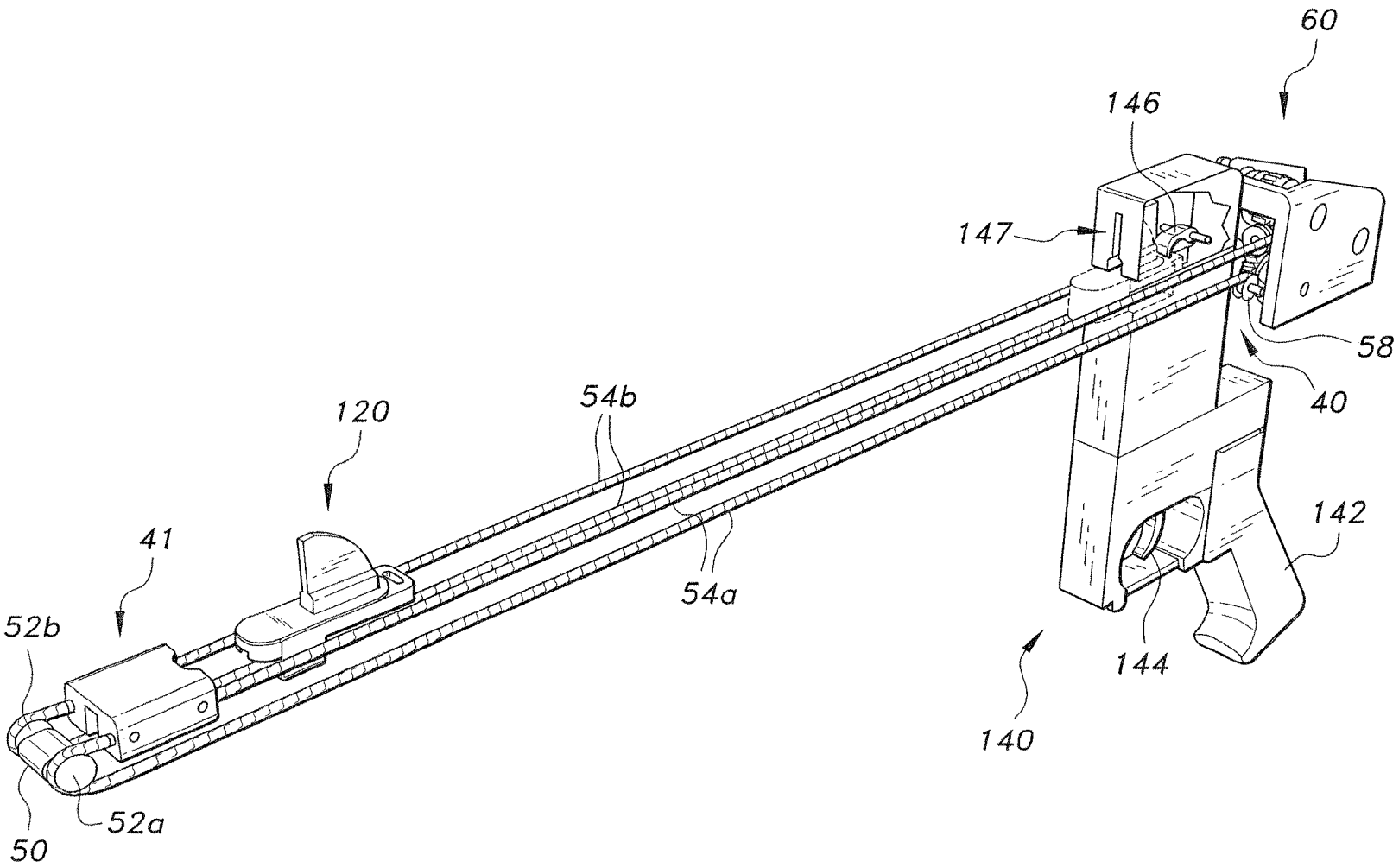
FIG. 3 is a perspective view of the cocking mechanism, crank mechanism, and trigger assembly of the projectile launcher of FIG. 1.
Figure 4:
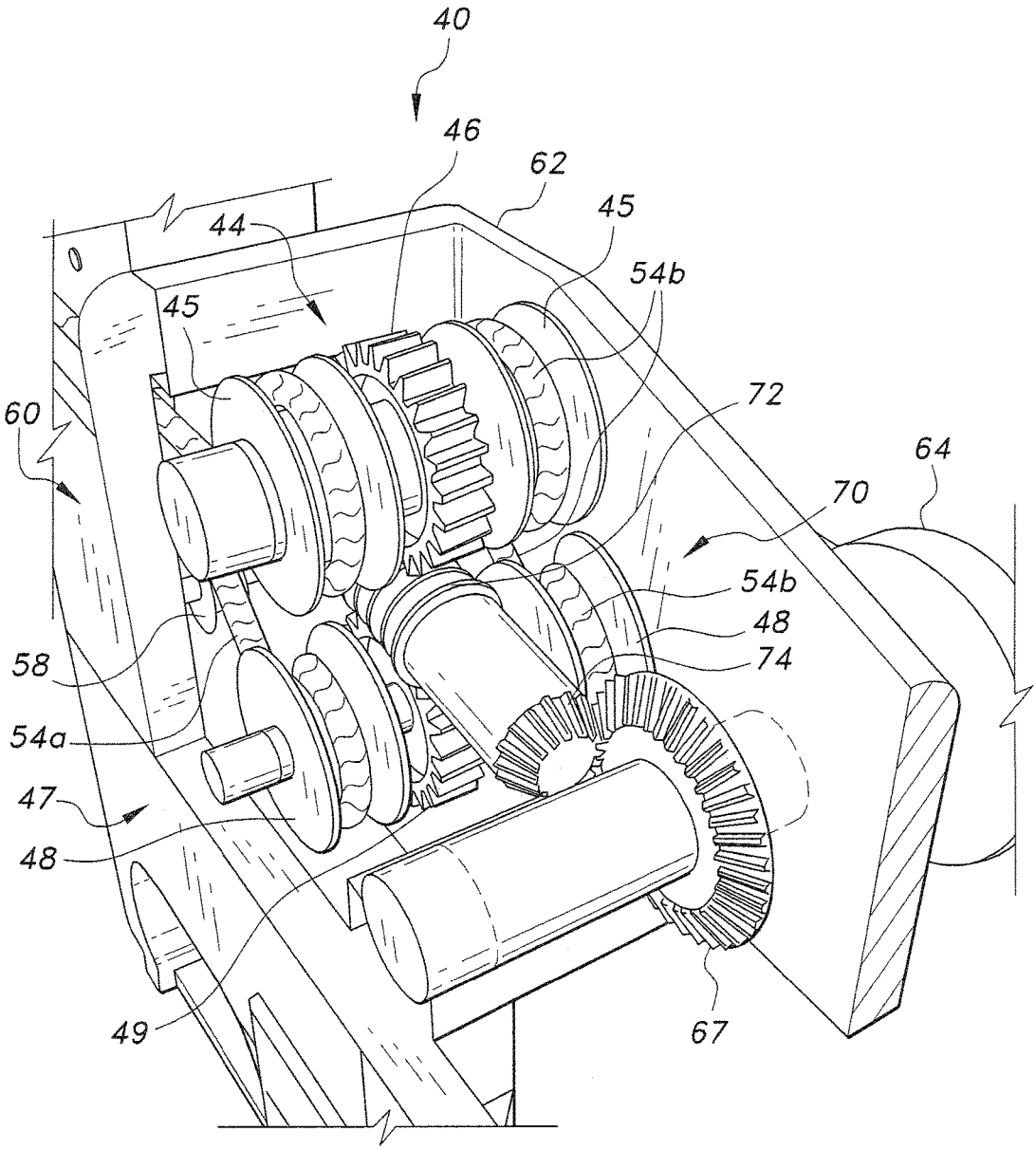
FIG. 4 is a detailed perspective view of the crank mechanism for the projectile launcher of FIG. 1.

As best seen in FIGS. 3 and 4, the cocking mechanism 40 for the projectile launcher 10 includes a crank mechanism 60 mounted to the proximal end of the rail system 30 and the reciprocating cocking carriage 41. A crank housing 62 encloses the working components of the crank mechanism 60. As best seen in FIG. 4, the crank mechanism 60 includes a crank 64 rotatably mounted to the crank housing 62. An elongate crank arm 65 is pivotally attached to one side of the crank 64 at one end, and a handle 66 protrudes transversely from the other end. The crank arm 65 is preferably constructed as an elongate plate, and the handle 66 is preferably shaped as an elongate, cylindrical post either rotatably mounted or non-rotatably fixed to the distal end of the crank arm 65. By this hinged construction of the crank arm 65, both the handle 66 and the crank arm 65 can be pivoted between use and non-use positions, where the former position extends the crank arm 65 radially outward, providing leverage for manual rotation, and the latter position stows the handle 66 into a corresponding hole on the crank housing 62 or side panel 22 when not in use. It is noted that either side panel 22, 24, the crank housing 62, or similar covering can be provided with a hole, depending on user preference, i.e., right- or left-hand operation. The pivoting crank arm 65 arrangement adds to the compact, streamlined form factor for the projectile launcher 10.

The opposite side of the crank 64 includes a coaxial bevel gear 67. This bevel gear 67 interacts with an elongate transmission gear assembly 70. The transmission gear assembly is preferably constructed as a substantially elongate post having a combination of gears formed thereon. One end of the transmission gear assembly 70 is rotatably mounted to the back of the rail system 30 and includes an intermediate worm gear 72 along a majority of the length of the post, and a bevel gear 74 at the opposite end. The bevel gear 74 of the transmission gear assembly 70 meshes with the bevel gear 67 of the crank 64. Thus, rotation of the crank 64 facilitates simultaneous rotation of the transmission gear assembly 70.

The connection of the transmission gear assembly 70 to the back of the rail system 30 can be provided by a simple rotating connection or by other like means, e.g., a non-circular boss that can be inserted into a correspondingly shaped mounting recess or hole where the attached end of the transmission gear assembly 70 can rotate with respect to the boss. This exemplary construction more securely mounts the transmission gear assembly 70 to the rail system 30. Other alternative constructions can also be utilized, such as a biased locking connection that permits removable mounting of the transmission gear assembly 70 while remaining free to rotate in response to the rotation of the crank 64. Additionally, a pair or more of the transmission gear assemblies 70 can be provided for ease of operation and/or increased mechanical advantage.

The cocking mechanism 40 also includes a first or upper pulley assembly 44 rotatably mounted inside the crank housing 62 above the transmission gear assembly 70, and a second or lower pulley assembly 47 rotatably mounted inside the crank housing 62 below the transmission gear assembly 70. Each pulley assembly is constructed as a combined, integral component having a pair of pulley wheels coaxial with a gear. Each pulley wheel can also be referred to as a pulley roller. Thus, the upper pulley assembly 44 includes a pair of first or upper pulley wheels 45 integrally connected to a first or upper gear 46, while the lower pulley assembly 47 includes a pair of second or lower pulley wheels 48 integrally connected to a second or lower gear 49. The upper gear 46 is preferably disposed between the pair of upper pulley wheels 45. Similarly, the lower gear 49 is disposed between the pair of lower pulley wheels 48. This configuration provides a very compact arrangement for the components of the cocking mechanism 40. Placing the gears 46, 49 on either side of the pulley assemblies 44, 47 would significantly widen the cocking transmission assembly.

Each gear 46, 49 meshes with the worm gear 72 on the transmission gear assembly 70, and rotation of the worm gear 72 causes the upper and lower gears 46, 49 to concurrently rotate in opposite directions. In other words, when the upper gear 46 rotates clockwise via rotation of the worm gear 72, the worm gear 72 causes the lower gear 49 to simultaneously rotate counterclockwise, and vice versa.

A pair of cocking cables 54*a*, 54*b* is coupled to the upper pulley wheels 45 and lower pulley wheels 48. One end of a first cocking cable 54*a* is anchored to each upper pulley wheel 45 and lower pulley wheel 48 to one side of the respective upper gear 46 and lower gear 49, and a second cocking cable 54*b* is anchored to each upper pulley wheel 45 and lower pulley wheel 48 to the other side of the respective upper gear 46 and lower gear 49. Both ends of the cocking cables 54*a*, 54*b* extend through the back of the rail system 30 to wind around respective upper and lower pulley wheels 45, 48 as best seen in FIG. 4. Rotation of the upper and lower pulley wheels 45, 48 simultaneously winds and unwinds the cocking cables 54*a*, 54*b*. The cocking carriage 41 is attached to the cocking cables 54*a*, 54*b* at an intermediate section thereof and forced to move in response to the winding and rewinding rotations of the upper and lower pulley wheels 45, 48 on the cocking cables 54*a*, 54*b*. Since the cocking carriage 41 is slidably mounted inside the channel of the lower rail section 34, the cocking carriage 41 is confined to reciprocate therein.

To facilitate the reciprocating movement of the cocking carriage 41, the cocking cables 54*a*, 54*b* are trained around a pair of first idle pulley wheels or rollers 52*a*, 52*b* rotatably mounted to a first idler mounting block 50 at the distal end of the lower rail section 34, and to proximal second idle pulley wheels or rollers 58 rotatably mounted within the crank housing 62, as best shown in FIGS. 3 and 4. For simplicity of description, the trained arrangement of the cocking cables 54*a*, 54*b* is described as beginning from the upper pulley wheels 45. From the upper pulley wheel 45, a section of the cocking cables 54*a*, 54*b* extends into the channel or slot 35 of the lower rail section 34 and is attached to one end of the cocking carriage 41. The remaining section of the cocking cables 54*a*, 54*b* extends from the other end of the cocking carriage 41 and trains around the first idle pulley wheels 52*a*, 52*b* and the second idle pulley wheels 58 to connect with the lower pulley wheels 48. In order to insure proper movement of the cocking cable 54*a*, 54*b* during use, the bottom panel or wall of the lower rail section 34 can include an elongate guide groove 36 for guiding and defining the path of the cocking cables 54*a*, 54*b* to and from the lower pulley wheel 48. The guide groove 36 also assists in preventing fraying or damage to the cocking cables 54*a*, 54*b*.

Figure 7:
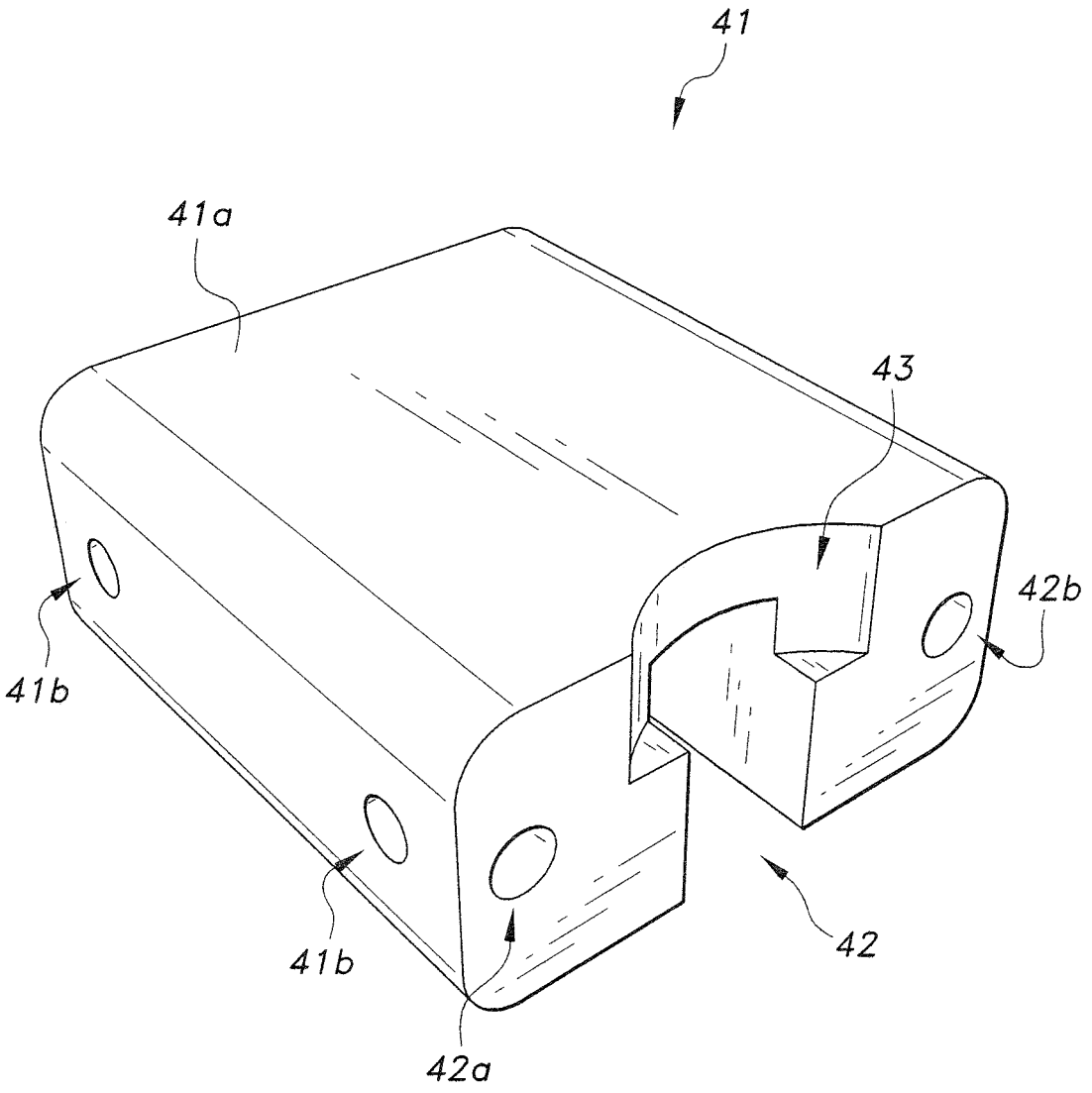
FIG. 7 is a perspective view of the cocking carriage for the projectile launcher of FIG. 1.

As best seen in FIG. 7, the cocking carriage 41 is preferably constructed as a generally elongate, rectangular block 41*a* having an elongate, cable groove or channel 42 extending along the whole length of the cocking carriage 41. The cable channel 42 is formed on one side, preferably the bottom or underside, of the block 41*a* at the center thereof. The cable channel 42 enables free passage of a cable attached to the projectile nock carriage 120 during the cocking operation. An arcuate engagement notch, recess, or groove 43 is formed on one end of the block 41*a*. The engagement notch 43 selectively engages the front of the projectile nock carriage 120 during the cocking operation, and the shape of the engagement notch 43 conforms to the shape of the front of the projectile nock carriage 120 to ensure secure, selective engagement thereto. Since the cocking carriage 41 slides within the lower rail section 34, the surfaces of the cocking carriage 41 and/or the interior surfaces of the channel in the lower rail section 34 can be provided with a coating or layer of friction reducing material, such as Teflon, in order to insure smoothness and ease of sliding movement.

Opposite ends of the block 41*a* are provided with a pair of cocking cable grooves or slots 42*a*, 42*b* disposed on either side of the cable channel 42. Each end pair of cocking cable grooves 42*a*, 42*a* or 42*b*, 42*b* near a side of the block 41*a* enables mounting of a respective end of a section of the cocking cables 54*a* or 54*b*. For example, one end of the section of the cocking cable 54*a* extending from the upper pulley wheel 45 mounts to one of the cable grooves 42*a*, and one end of a section of the cocking cable 54*a* extending towards the idle pulley wheel 52*a* mounts to the other of the cable grooves 42*a* on the opposite end of the block 41*a*. Similar mounting is facilitated with the cocking cable 54*b* and the cable grooves 42*b*. The inserted ends of the cocking cable 54*a*, 54*b* may be secured to the cocking carriage 41 by set screws or anchor pins 41*b* on each side of the block 41*a*. Each cable groove 42*a*, 42*b* may extend a predetermined distance into the block 41*a* or form a through bore between each side pair of cable grooves 42*a*, 42*a* or 42*b*, 42*b*. Whether the cable grooves 42*a*, 42*a*, 42*b*, 42*b* extend partially or completely through the block 41*a*, the cocking carriage 41 must be mounted in a manner such that the relative position of the cocking carriage 41 is set or fixed at a predetermined position along the length of the cocking cables 54*a*, 54*b*, at least for the cocking operation. Any sliding movement of the cocking carriage 41 during the cocking operation would prevent the cocking carriage 41 from pushing the projectile nock carriage 120 into the cocked position.

In use, the projectile launcher 10 is placed so that the bumper 38 at the front of the projectile launcher 10 rests on the ground or any suitable bracing surface or object. Operation of the crank mechanism 60 in one direction slides the cocking carriage 41 until the engagement notch 43 engages the front of the projectile nock carriage 120. Continuous cranking causes the cocking carriage 41 to push the projectile nock carriage 120 towards the rear or proximal end of the barrel assembly 20 until the projectile nock carriage 120 is in the fully cocked position. At this point, the projectile nock carriage 120 is locked in place by, e.g., a releasable catch or finger 146 of the trigger assembly 140. Prior to releasing the catch 146, the crank mechanism 60 is rotated in the opposite direction, causing the cocking carriage 41 to slide back towards the front or distal end of the barrel assembly 20. At this point, the cocking carriage 41 nestles within the distal end by abutting against the first idler mounting block 50.

The kinetic energy for propelling the projectiles B is provided by a bow assembly 80 attached to the riser base 12. Any means for selectively storing potential energy during a cocking operation and releasing the potential energy as kinetic energy when fired is also referred to as a propulsion system. The term "bow assembly" is used because it includes bow elements that tension connected cables and transfer the energy stored therein to accelerate the projectile B in a manner similar to various archery weapons. Unlike conventional crossbows, the bow assembly 80 is configured in a reversed and vertical orientation as opposed to front-facing and horizontal. Moreover, the projectile launcher 10 is provided with a covering 11 that encloses the bow assembly 80 and associated components, which protects the bow assembly 80 from the elements and provides a safety feature for the user. Any noise that may be generated by the operation of the bow assembly 80 will also be muffled by the covering 11. This configuration of the bow assembly 80 provides the projectile launcher 10 with a compact, streamlined form, which eliminates the potential hindrances of horizontally extending bow arms in conventional crossbows. As shown in FIGS. 1, 2, 8A, and 8B, the bow assembly 80 includes a flexible, resilient upper bow arm, limb or lath 82 attached to the mounting ledge 15 on the vertical short section 14, and a flexible, resilient lower bow arm, limb or lath 86 attached to the bottom of the short section 14.

The upper bow arm 82 is constructed as an elongate, flat split-beam having one end secured to the mounting ledge 15 by an upper mounting plate 83 and bolts 84. The upper bow arm 82 includes a relatively wide section that tapers to a relatively short, narrow section 85.

Similarly, the lower bow arm 86 is constructed as an elongate, flat split-beam having one end secured to the bottom of the short section 14 by a lower mounting plate 87 and bolts (not seen due to perspective of the Figures). The lower bow arm 86 includes a relatively wide section that tapers to a relatively short, narrow section 89. Although both the upper and lower bow arms 82, 86 include wide and narrow sections, the bow arms 82, 86 are not identically shaped due to the bow flexing assembly 100 attached to the narrow sections 85, 89. However, the different width sections are generally preferred for each bow arm 82, 86, where the wide section provides the durability and strength for flexure and the narrow section eases flexing of the bow arms 82, 86. The split-beam design also provides greater flexibility and reduced weight, while preserving the desired strength of performance. Alternative constructions, such as a beam with continuous tapering sides and the like, can also be used for similar purpose. In general, the sizes and shapes of the upper and lower bow arms 82, 86 can be selected in concert with the flexing assembly 100 configuration and mass distribution to create the required energy storage and minimized center of mass shifts during firing, as described more fully below. Thus, and alternatively, identical upper and lower bow arms 82, 86 can be employed with corresponding accommodation of the flexing assembly 100.

Figure 8A:
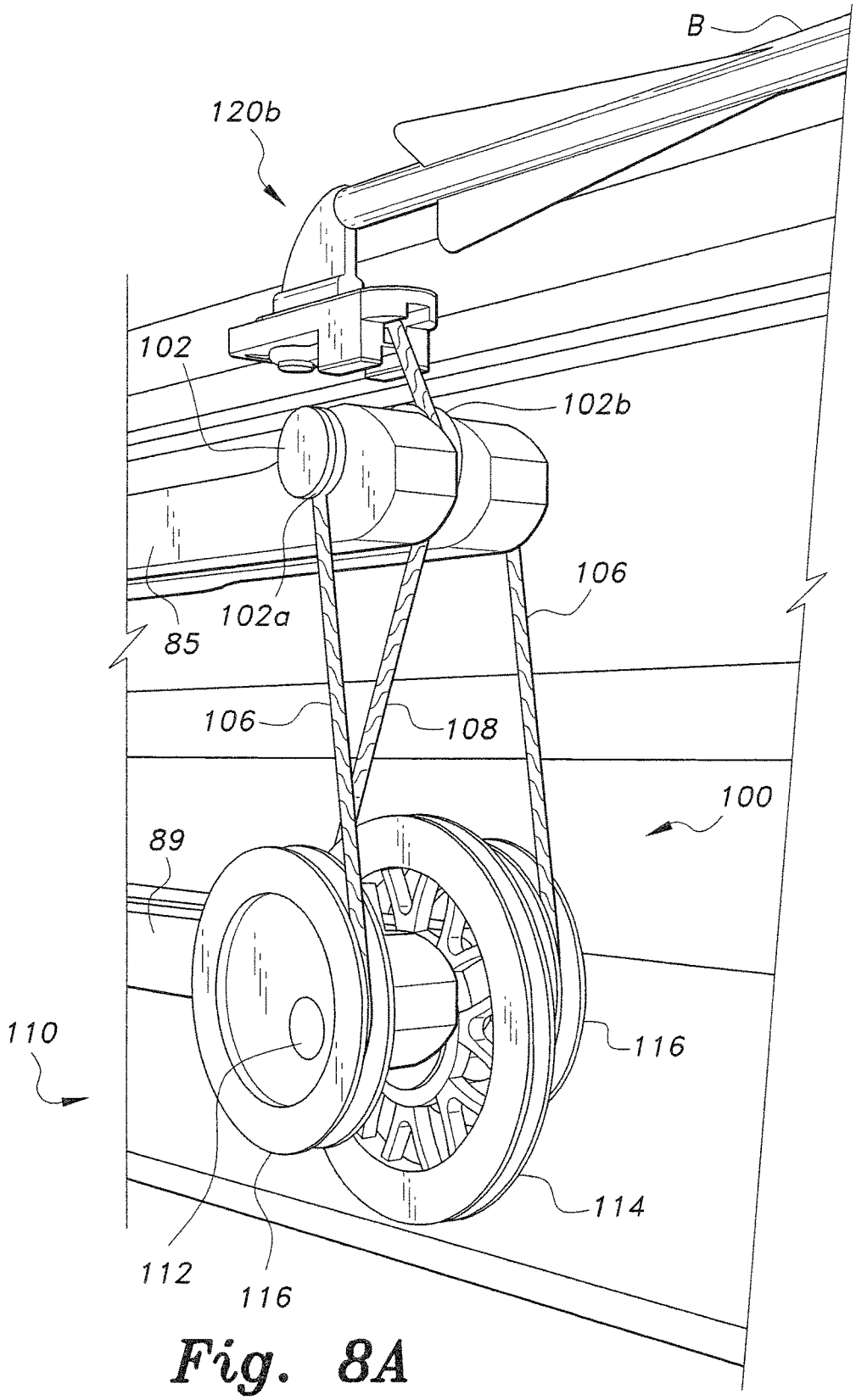
FIG. 8A is a detailed perspective view of a flexing assembly for the projectile launcher of FIG. 1.
Figure 8B:
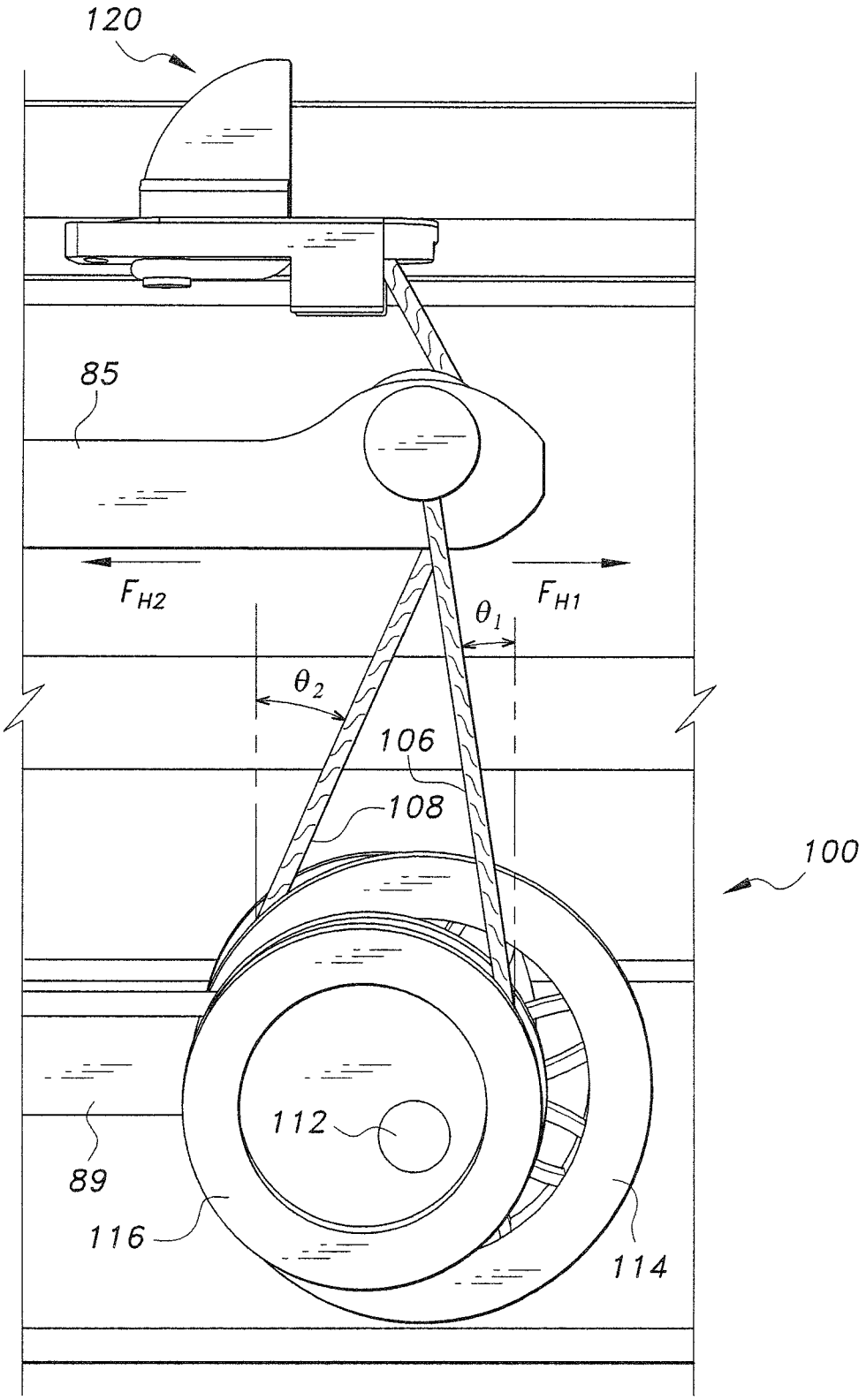
FIG. 8B is a detailed side perspective view of the flexing assembly of FIG. 8A.

As best seen in FIGS. 8A, and 8B, the flexing assembly 100 includes a trunnion 102 rotatably mounted near the distal end of the upper narrow section 85 and a cam pulley assembly 110 rotatably mounted to the lower narrow section 89. The cam pulley assembly 110 includes a rotatable shaft 112, an inner pulley wheel or roller 114, and a pair of outer cam pulley wheels 116.

The rotatable shaft 112 extends completely through distal ends at the prongs of the lower narrow section 89, and the rotatable shaft 112 has suitable length to accommodate mounting of the cam pulley wheels 116 outside the prongs' distal ends such that the cam pulley wheels 116 cap opposite ends of the rotatable shaft 112. The inner pulley wheel 114 is mounted to the rotatable shaft 112 between the prong ends of the narrow section 89. This configuration reduces overall weight of the projectile launcher 10 compared to a propulsion system that utilizes a plurality of pulley wheels.

The flexing assembly 100 is also provided with a pair of first flex cables 106. Each first flex cable 106 is anchored at one end to an anchor stub 102*a* of the trunnion 102, protruding laterally from the sides of the upper narrow section 85. The remainder trains downward towards the lower, outer cam pulley wheels 116, where the opposite end of the respective first flex cable 106 anchors thereon. A second flex cable 108 has one end anchored to the inner pulley wheel 114, and the opposite end is anchored to the projectile nock carriage 120. A portion of the second flex cable 108 trains around a guide roller or pulley wheel 102*b* rotatably mounted to the trunnion 102 between the prong ends of the upper narrow section 85.

The interaction between the flex cables and the pulley wheels flexes the bow arms 82, 86 towards each other to cock the bow assembly 80. During the above-described cocking operation, forced movement of the projectile nock carriage 120 towards the proximal or butt end of the projectile launcher 10 rotates the inner pulley wheel 114 (clockwise in the view shown in FIGS. 8A and 8B) through the connection with the second flex cable 108. This, in turn, tensions the first flex cables 106 by concurrent rotation of the outer cam pulley wheels 116, which forces the upper bow arm 82 and the lower bow arm 86 to flex toward each other.

The inner pulley wheel 114 is rigidly attached to and centered on the shaft 112 while the outer cam pulley wheels 116 are rigidly attached to the shaft 112 at an offset or eccentric axis. The inner pulley wheel 114 has a given, preselected diameter. Each outer cam pulley wheel 116 is mounted to respective ends of the shaft 112 outside each prong end of the lower narrow section 89. The diameter of the inner pulley wheel 114 is preferably larger than the outer cam pulley wheels 116. Due to the eccentric axial mounting of the outer cam pulley wheels 116, rotation of the inner pulley wheel 114 causes a corresponding cam rotation of the outer cam pulley wheels 116. Unlike a traditional compound crossbow mechanism that has analogous but loosely synchronized pairs of inner and outer pulley wheels, the rigid attachment of the inner and outer pulley wheels 114, 116 to the shaft 112 ensures that rotational synchronization of the flexing assembly 100 is maintained at all times, which improves shooting accuracy by ensuring consistent tensioning of the attached cables for firing the projectile B.

Each inner and outer pulley wheel 114, 116 can be constructed as separate components. However, they are preferably integrally fixed to each other by some means, such as fasteners or adhesive, in order to preserve the desired camming effect. A more preferred construction of the inner and outer pulley wheels 114, 116 includes molding or machining. One or more of the wheels preferably include a plurality of cutouts to minimize weight and rotational inertia.

As best seen in FIG. 8B, the cable arrangement between the upper bow arm 82 and the lower bow arm 86 has been configured to minimize effects of the horizontal component of force from the tension of the cables 106, 108 acting on the distal ends of the bow arms 82, 86. More preferably, the net result of the horizontal component of forces should be zero. This is achieved by the different angular disposition of the cables. As shown, a first angle $\theta_1$ of extension of the first flex cable 106 with respect to the vertical is different from a second angle $\theta_2$ of the second flex cable 108, the first flex cable 106 extending at a minor opposite direction with respect to the second flex cable 108. For a given amount of tension force exerted via the cocking operation, the horizontal component of force $F_{H2}$ for the second flex cable 108 is generally greater than the corresponding horizontal component of force $F_{H1}$ for the first flex cable 106, the horizontal forces acting in opposite directions. The flexing assembly 100, however, includes a pair of first flex cables 106 resulting in twice the amount of horizontal force $F_{H1}$. The sum of the horizontal forces $F_{H1}$ is about the same as the single horizontal force $F_{H2}$. Since the horizontal forces act in opposite directions, the net result is generally null in the horizontal direction. This net result ensures that the forces affecting the ends of the bow arms 82, 86 are concentrated more in the vertical direction rather than the horizontal, which also reduces axial stresses at the trunnion 102 and the rotatable shaft 112 during operation.

Figure 9B:
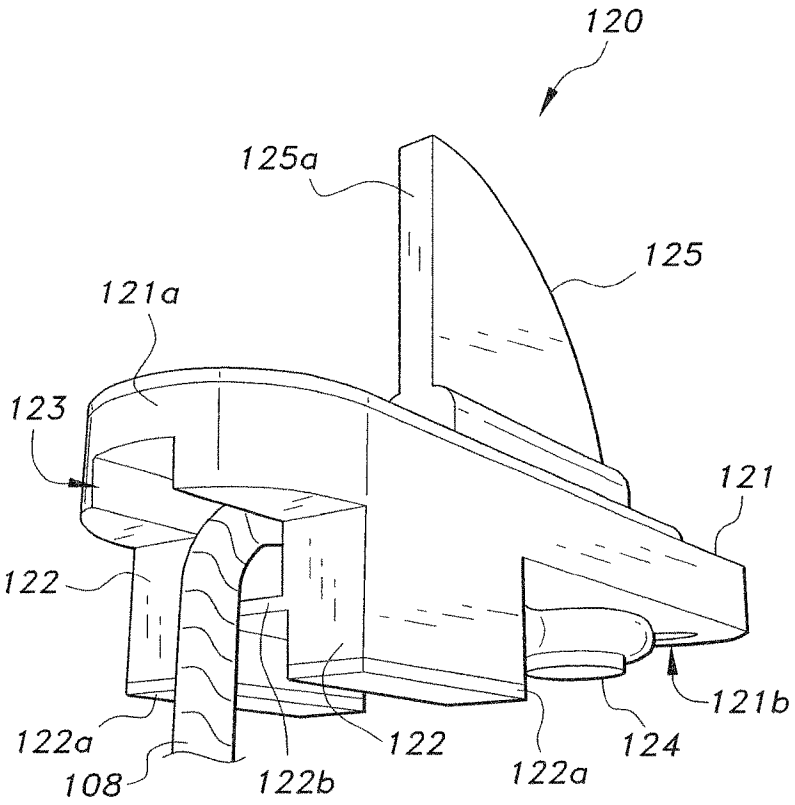
FIG. 9B is a detailed bottom perspective view of the projectile nock carriage of FIG. 9A.
Figure 9A:
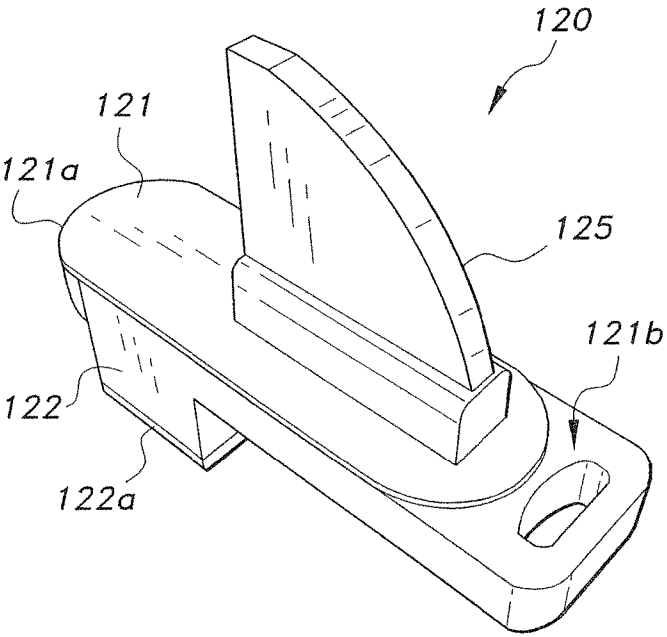
FIG. 9A is a detailed top perspective view of a projectile nock carriage for the projectile launcher of FIG. 1.

The projectile nock carriage 120 is best shown in FIGS. 9A and 9B. As shown, the projectile nock carriage 120 includes an elongate base 121, generally oblong in shape. The width of the base is dimensioned and configured to slidably fit inside the horizontal slot 35 of the lower rail section 34 with suitable clearance for smooth, unhindered movement. The front end 121*a* of the base 121 is rounded. This rounded end 121*a* is also stepped in order to self-adjust and securely seat within the arcuate engagement notch 43 on the cocking carriage 41 during the cocking operation to push the projectile nock carriage 120 into the fully cocked position. The opposite end of the base 121 is provided with a trigger catch slot 121*b* configured to be selectively engaged by one or more catch fingers 146 in a trigger assembly 140 when fully cocked.

The base 121 is relatively flat or thin to minimize weight. However, the thinness leaves enough vertical space within the horizontal slot 35 to enable stable sliding of the projectile nock carriage 120. To compensate, the base 121 includes a pair of spaced leg members 122 depending or extending downward from the base 121. The leg members 122 extend the height of the base 121 such that the base 121, together with the leg members 122, occupy a substantial portion of the height of the horizontal slot 35 with suitable clearance to enable smooth sliding movements of the projectile nock carriage 120. Each leg member 122 may also be provided with a wear plate or foot 122*a* constructed from friction-reducing material, such as Teflon or the like. This will increase longevity and operational effectiveness for transferring kinetic energy to the projectile B, since the projectile nock carriage 120 will be subjected to sliding movements. One or more surfaces of the projectile nock carriage 120 may also be generally frictionless via a friction-reducing layer, coating, or material construction.

Aside from defining the height of the base 121, the leg members 122 also provide a support structure for threading and anchoring the second flex cable 108 to the projectile nock carriage 120. As best seen in FIG. 9B, the bottom of the base 121 includes an elongate cable groove 123 extending from the front end 121*a* towards the back end. A cable support web 122*b* extends between the leg members 122 at about midway up the height of the leg members 122. In use, the second flex cable 108 threads through the cable groove 123 towards the back end of the base 121. The cable support web 122*b* supports the underside of the second flex cable 108 and enables the second flex cable 108 to bend into the cable groove 123. The cable support web 122*b* forms a closed channel for passage of the second flex cable 108. The bottom of the base 121 is provided with an anchor post 124 near the back end to secure the end of the second flex cable 108, which is threaded through the cable groove 123 onto the projectile nock carriage 120. The placement of the anchor post 124 is preferably on or as near as possible to the center of mass of the projectile nock carriage 120 to align the center of mass with the propulsive force exerted by the second flex cable 108 during firing. The bottom of the horizontal slot 35 includes a cable pass-through slot 35*a* formed therein to enable unhindered attachment of the second flex cable 108 to the projectile nock carriage 120 and unhindered movement along the horizontal slot 35 during the cocking and loosing operations.

A nock fin or finger 125 extends vertically from the top of the base 121. The nock fin 125 is preferably a generally planar, angled plate with a flat nock face 125*a* and a generally inverted T-shaped cross-sectional profile. The nock face 125*a* abuts the back of the projectile B when cocked and pushes the projectile B when the trigger assembly 140 is released. The nock fin 125 is configured to ride within the vertical slot 33 in the rail system 30.

The shape of the nock fin 125 is configured to efficiently deliver the propulsive force from the flexing assembly 100 and the like. The cross or horizontal portion of the inverted T-shape provides a strong foundation suitable for withstanding the abrupt stresses experienced during firing. The relatively thin, vertical portion of the nock fin 125 is preferably rounded or arcuate in side profile. The arcuate profile results in a vertical portion that is lightweight, as compared to, e.g., a rectangular section, and provides a degree of flexibility near the top for added propulsion. The reduced weight minimizes any kinetic energy loss associated with the mass of the projectile nock carriage 120.

The trigger assembly 140 includes a detachably mounted block having a grip 142, a trigger 144, and one or more catches or fingers 146 disposed near the top of the block. The trigger assembly extends through the slot 17 of the rail system 30, and the releasable catch(es) 146 engage the trigger catch slot 121*b* when the projectile nock carriage 120 is in the cocked position. Pulling the trigger 144 releases the catch(es) 146. The top of the trigger assembly 140 or the crank housing 62 can be provided with a mounting system (not shown) for mounting scopes and other similar sights to assist aim. The trigger assembly 140 may also include a nock carriage slot 147 to enable the projectile nock carriage 120 to rest within the block in the fully cocked position.

In operation, the cocking carriage 41 pushes the projectile nock carriage 120 back towards the trigger assembly 140 against the resistance of the second flex cable 108. The movement of the nock carriage 120 causes the second flex cable 108 to pull away from the inner pulley wheel 114, thereby rotating the same. Rotation of the inner pulley wheel 114 simultaneously rotates the outer cam pulley wheels 116. This action winds the first flex cables 106 around the outer cam pulley wheels 116, forcing the upper and lower narrow sections 85, 89 of the upper and lower bow arms 82, 86 to flex toward each other. At this point, the projectile nock carriage 120 is cocked and ready to be released. Upon release of the catch 146 by the user pulling the trigger 144, the built-up tension in the second flex cable 108 is released, causing the projectile nock carriage 120 to rapidly accelerate along the upper rail section 32 towards the front thereof. This action launches the projectile B carried by the projectile nock carriage 120.

Unlike modern conventional crossbows, the projectile launcher 10 can be dry-fired without risk of damage to the bow assembly 80 due to the mass of the projectile nock carriage 120. If a user dry-fires such a conventional crossbow, the kinetic energy transfers back into the bowstring and the various components of the crossbow, rather than to the bolt. With some crossbows having a draw weight in the hundreds of pounds, that is a considerable amount of energy to be absorbed. This leads to potential damage, such as breaks in the bow limbs and/or bowstring, failure or breakage in the cams and pulleys, etc., which can potentially result in flying parts that can harm the user. In contrast, the mass of the projectile nock carriage 120 acts as a focus for dissipating the released energy as it travels towards the front of the rail system 30 past the normal position at the midpoint of the rail system 30 and decelerates at the end of the firing cycle. In other words, the momentum of the projectile nock carriage 120 towards the end of travel, i.e., the distal end of the rail system 30, pulls against or counteracts the natural rebounding flexure of the bow arms 82, 86, thereby dissipating the potential energy after firing. While benefiting dry-firing conditions, this effect occurs to a lesser degree in normal firing conditions. The nock carriage 120 will still overrun its normal midpoint position when firing a projectile B, and any residual energy will be dissipated by the overrun. This overrun of the projectile nock carriage 120 at the completion of firing also has the effect of eliminating vibration in the second flex cable 108, which can generate unwanted noise. Thus, an extremely quiet operation can be facilitated. The string/cable vibration at the end of firing in a traditional crossbow is more than an annoyance, and reduces the desired stealth of operation that is highly prized in hunting applications. It is noted that this anti-vibration effect occurs in both firing and dry-firing conditions.

The pulley system in the bow assembly 80 functions in a similar manner to conventional compound bows. The cam pulley assembly 110 allows the bow arms 82, 86 to be drawn and the draw to be maintained without continuous effort, as in non-compound bows. Depending on the desires or requirements of the user, the cam pulley assembly 110 can be constructed with various different cam profiles to facilitate the desired draw characteristics.

Dynamic balancing of forces must be maintained as much as possible between the arms 82, 86 in order to prevent potential deviations in the aim line and accuracy of the projectile launcher 10. The bow arms 82, 86 may not necessarily be identical, and the components of the flexing assembly 100 mounted onto the bow arms 82, 86 may be of generally different masses. Therefore, the aggregate center of mass of the combined bow assembly 80 and flexing assembly 100 may translate in the vertical plane during cocking and firing operation. In other words, the different configuration of the upper and lower bow arms 82, 86 and flexing assembly 100 mounting configuration could cause the releasing momentum to be directed at an angle from the aim line. In order to compensate, the combined bow assembly 80 and flexing assembly 100 are constructed to be dynamically balanced such that their aggregate center of mass is invariant in the vertical plane during cocking and firing operation. For example, the upper bow arm 82 can be provided with a weighted end (not shown) and/or larger cross section to the upper narrow section 85. In addition, the materials for constructing the bow arms 82, 86 can be selected and assembled to provide the desired flex and balance. Moreover, the masses of the inner and outer pulley wheels 114, 116 can be tuned by adjustment of thickness, size of cut-outs, etc. to create the desired mass distribution in combination with the aforementioned adjustments. Similar dynamic force balancing may be accomplished through selection of densities and/or weights of the component materials.

Thus, it can be seen that the projectile launcher 10 provides an unencumbered and easy to operate crossbow-like weapon in a significantly more compact and streamlined form. Since the working components of the projectile launcher 10 are enclosed or confined within a guarded or protected structure, the user can operate and fire the projectile launcher 10 without the safety and operational concerns of conventional crossbows. Moreover, the reversed and vertically oriented internal bow assembly 80 and associated structural support and the placement thereof results in a balanced weapon, enhancing portability, operation, and aim.

Figure 10A:
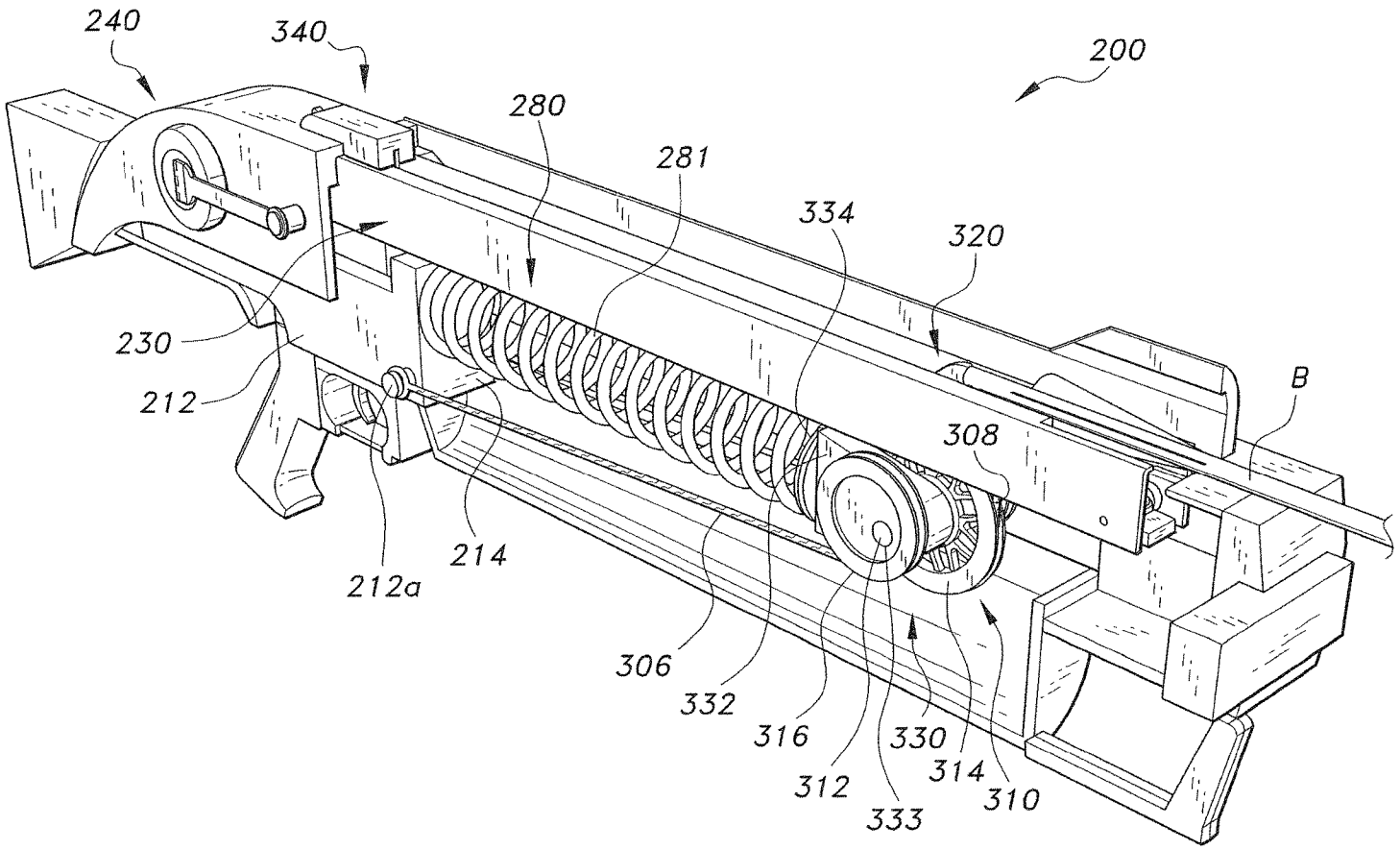
FIG. 10A is a perspective view of a second embodiment of a projectile launcher according to the present invention, shown with part of the side panel removed for clarity.
Figure 10B:
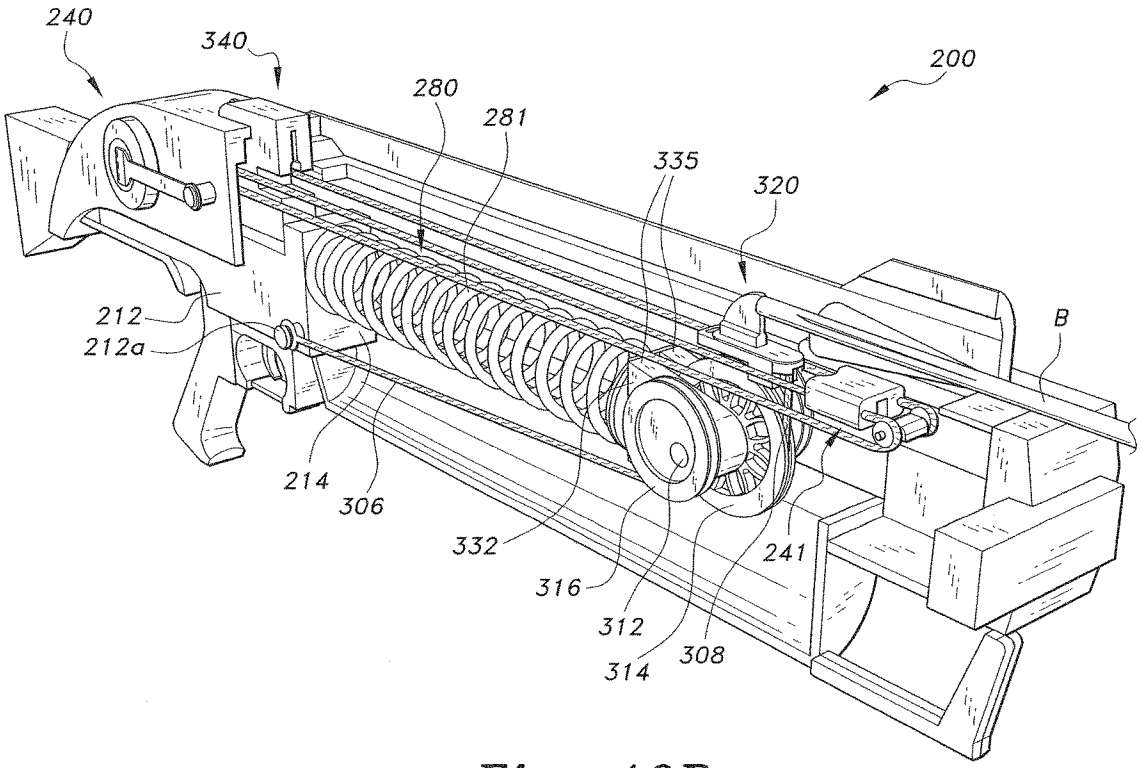
FIG. 10B is a perspective view of the projectile launcher of FIG. 10A, shown with the rail system removed to show additional details.

Another embodiment of a projectile launcher is shown in FIGS. 10A and 10B. Initially, it is noted that the following description and corresponding reference numbers will be primarily focused on features different from the previous embodiments for clarity and brevity. In this embodiment, the projectile launcher 200 utilizes a variant propulsion system to the previously described bow assembly in order to propel a projectile.

As shown, the projectile launcher 200 includes a rail system 230, a projectile nock carriage 320 slidably attached to the rail system 230, a trigger system 340 to selectively hold and release the nock carriage 320, and a cocking mechanism 240. These features are substantially the same and function as those of the previously described projectile launcher, e.g., projectile launcher 10.

Unlike the previous embodiment, the projectile launcher 200 includes a biased propulsion system 280 disposed below the rail system 230. The biased propulsion system 280 includes an elongate compression or coil spring 281 and a freely movable cam pulley carriage 330 operatively connected thereto. Selective compression of the compression spring 281 during cocking of the projectile launcher 200 stores potential energy, and upon release, transforms the potential energy into kinetic energy to propel a projectile B attached to the projectile nock carriage 320.

The compression spring 281 extends a substantial length of the rail system 230 in the normal, uncocked state. Each opposite end of the compression spring 281 has been formed or ground to have a flat, planar surface. When assembled and during operation, the flat surfaces at the ends prevent potential rolling or rocking movement of the compression spring 281 with respect to the surface each end abuts. Any such rolling movement can potentially displace the compression spring 281 out of proper alignment for transmitting the motive force, which can ultimately affect the aim and trajectory of the projectile being loosed.

The front side of a riser base 212 presents a substantially flat, planar surface 214. The planar surface 214 supports abutment of one end of the compression spring 281. The respective flat surfaces between the end of the compression spring 281 and the planar surface 214 provide a stable, operative connection between the riser base 212 and the compression spring 281.

The opposite end of the compression spring 281 is operatively connected to the cam pulley carriage 330. As shown, the cam pulley carriage 330 includes a carriage body 332 and a cam pulley assembly 310 mounted thereon. The carriage body 332 is preferably a substantially wedge-shaped member and includes a throughbore near the front for selective insertion of a rotatable support shaft, rod or axle 312. The substantial wedge-shape of the carriage body 332 provides the body 332 with a lightweight and aerodynamic profile, which assists in minimizing potential drag and any degradation of motive force being transmitted when the compression spring 281 is released from the compressed, cocked position. Although the travel distance may be relatively short in terms of distances in general, the acceleration of the carriage body 332 is very rapid when the compression spring 281 pushes against the carriage body 332 upon release from the cocked position. That type of acceleration in such a relatively short time period can cause drag, depending on the shape passing through the air. In the same vein, the carriage body 332 is desirably constructed to include at least one hole, aperture, or cutout, see e.g., FIG. 12, as a means of minimizing mass and weight. Moreover, the carriage body 332 is preferably forked or slotted along a vertical center line of a substantial portion of the carriage body 332 to form a pair of spaced carriage prongs 335, as best shown in FIG. 10B. The cutout and the forked configuration results in a carriage body with a much reduced mass, compared to a more solid body. Minimizing the mass of the carriage body 332 translates to maximal kinetic energy output to the projectile B, since less energy would be required to move that mass. The shape of the carriage body 332 also contributes to producing a lightweight component, the wedge shape being one of many lightweight shapes for the carriage body 332.

However, it is to be understood that the carriage body 332 can be constructed with different shapes and/or solid configurations. Other methods can be employed to maximize kinetic output by compensating for a given mass and/or reducing mass as much as possible. Some examples include, but are not limited to, adjusting the strength or stiffness of the compression spring 281, the material selection of the cam pulley carriage 330, a lattice construction of the carriage body 332, and the like.

As shown in the drawings, the tapered front end of the carriage body 332 includes the throughbore 333, while the back end is provided with a substantially flat surface 334. The flat surface of the opposite end of the compression spring 281 is in contact with the back flat surface 334 when assembled and during operation. As with the flat surface 214, the surface-to-surface contact between these flat planar surfaces provides a stable contact for pushing the carriage body 332, thereby ensuring that the carriage body 332 travels in the desired direction with maximal transfer of energy.

The cam pulley assembly 310 includes the rotatable support shaft 312 mounted through the throughbore 333, an inner pulley wheel or roller 314, and a pair of outer cam pulley wheels or rollers 316. The inner pulley wheel 314 is rigidly attached to the shaft 312 between the carriage prongs 335, and each outer cam pulley wheel 316 is coaxially and rigidly mounted to the shaft 312 at preferably an offset or eccentric axis with respective to the inner pulley wheel 314. When assembled, the inner pulley wheel 314 resides within prongs 335 of the carriage body 332. The diameter of the outer pulley wheels 316 is preferably smaller than the inner pulley wheel 314. Due to the eccentric axial mounting of the cam outer pulley wheels 316, rotation of the inner pulley wheel 314 causes a corresponding cam rotation of the outer pulley wheels 316. The specific construction of the inner and outer pulley wheels 314, 316 can be substantially the same as the inner and outer pulley wheels 114, 116 in the previously described projectile launcher 10. In some embodiments, both the inner and outer pulley wheels 314, 316 can be coaxially aligned, instead of offset. Such an arrangement can minimize small cyclical vertical shifting of the center of mass of the cam pulley assembly 310 during firing, which can further improve aim accuracy.

The transfer of motive force from the compression spring 281 is facilitated by flex cable connections. The biased propulsion system 280 includes a pair of first flex cables 306. Each first flex cable 306 is anchored at one end to an anchor stub 212*a* disposed on the sides of the riser base 212 below the horizontal line of extension of the compression spring 281. The remainder of each first flex cable 306 is wound around a respective outer cam pulley wheel 316, and the opposite end of each first flex cable 306 is anchored to the respective outer pulley wheel 316. A second flex cable 308 has one end anchored to the inner pulley wheel 314 of the cam pulley assembly 310. The second flex cable 308 extends from the inner pulley wheel 314 and anchors to the projectile nock carriage 320. The projectile nock carriage 320 is the same as the projectile nock carriage 120 of the previous embodiment, and the manner of securing the second flex cable 308 thereto is substantially the same. The interaction between the first and second flex cables 306, 308 and their effect on the cam pulley assembly 310 facilitates selective compression of the compression spring 281, and subsequently, controlled release of kinetic energy upon release of compression.

In use, the compression spring 281 is normally in a relatively uncompressed state, as shown in FIGS. 10A and 10B, which is exemplary of the uncocked position. However, a small amount of residual compression usually exists, ensuring that the flex cables 306, 308 are always taut. Otherwise, the cables 306, 308 might come off the pulleys after firing, or when cocking is started. The small amount of residual compression also causes the carriage body 332 to press against the compression spring 281. The carriage body 332 is normally attached to the compression spring by conventional means, such as via fasteners, welds, and the like. The residual compression insures that the compression spring 281 remains in a pre-compressed state during operation. It is similar in function to a strung bow in which the string is kept in constant tension. The lengths of the first flex cable 306 and the second flex cable 308 can also be adjustably fixed to provide the desired amount of tension, and thus pre-compression of the compression spring 281. Moreover, the mutual tension on the flex cables 306, 308 insures that they remained trained around their respective pulleys during operation.

When cocking the projectile launcher 200, the cocking mechanism 240 pushes the projectile nock carriage 320 towards the trigger system 340 by movement of the cocking carriage 241. This forces the second flex cable 308 to pull away and unwind from the inner pulley wheel 314. At the same time, the unwinding rotation (i.e., counterclockwise in FIGS. 10A and 10B) of the inner pulley wheel 314 forces the outer pulley wheels 316 to rotate in the same direction, pulling in and winding the first flex cables 306 thereon. The winding and unwinding actions of the flex cables 306, 308, through their connection to the cam pulley carriage 330, push the carriage body 332 towards the back of the projectile launcher 200 to thereby compress the compression spring 281 until the projectile nock carriage 320 is at the cocked position.

In the cocked position, in which the compression spring 281 has been compressed, the angular orientation of the first flex cable 306 and the angular orientation of the second flex cable 308 with respect to the virtual line of extension of the compression spring 281 are not equal with respect to each other. Additionally, supported forces of the first flex cables 306 and the supported forces of the second flex cable 308 are not equal, the first flex cables 306 supporting more force. However, due to the generally smaller angular orientation of the first flex cable 306 with the outer cam pulley wheels 316 compared to the second flex cable 308 with the inner pulley wheel 314, the net vertical forces are kept in balance, i.e., neither cable is exerting a greater net vertical force than the other that would tend to bend the compression spring 281 vertically, either up or down. The anchor stub 212*a* is disposed below the horizontal line of extension of the compression spring 281, which assists in maintaining the desired angular orientation of the first flex cables 306. This type of balance is preferably maintained in order to insure that the force exerted by the spring 281, when loosed or fired, remains horizontally level. This is another type of dynamic balance for use with the propulsion system 280.

After the projectile launcher 200 fires or loose the projectile B (or dry fires), the trained engagement of the first and second flex cables 306, 308 with their respective outer and inner pulley wheels 316, 314 insures rapid deceleration of the nock carriage 320 when the nock carriage 320 travels past the normal uncocked position along the rail system 230. As the momentum of the cam pulley carriage 330 forces the nock carriage 320 towards the distal end of the rail system 230 when fired, the inner pulley wheel 314 winds the second flex cable 308 thereon. Past the normal uncocked position, continuous winding by the inner pulley wheel 314 pulls on the nock carriage 320 to provide a braking force, the braking force increasing the farther the nock carriage 320 and/or the cam pulley carriage 330 travels past the uncocked position. The braking force is mainly caused by the nock carriage 320 being pulled down onto the rail system 230 as the length of the second flex cable 308 shortens due to the continued winding of the same around the inner pulley wheel 314. Additionally, continued motion of the nock carriage 320 past the normal uncocked position results in the first flex cables 306 unwinding and rewinding, which causes recompression of the compression spring 281, similar to the cocking operation described above. These two effects work to arrest the motion of both the cam pulley carriage 330 and the nock carriage 320.

Thus, the combined braking facilitated by the first flex cables 306 and the second flex cable 308 through their respective winding and unwinding actions on the inner pulley wheel 314 and outer pulley wheels 316 rapidly decelerates the nock carriage 320 and the cam pulley carriage 330. Some oscillations can occur, but the oscillations are minimal.

Figure 11A:
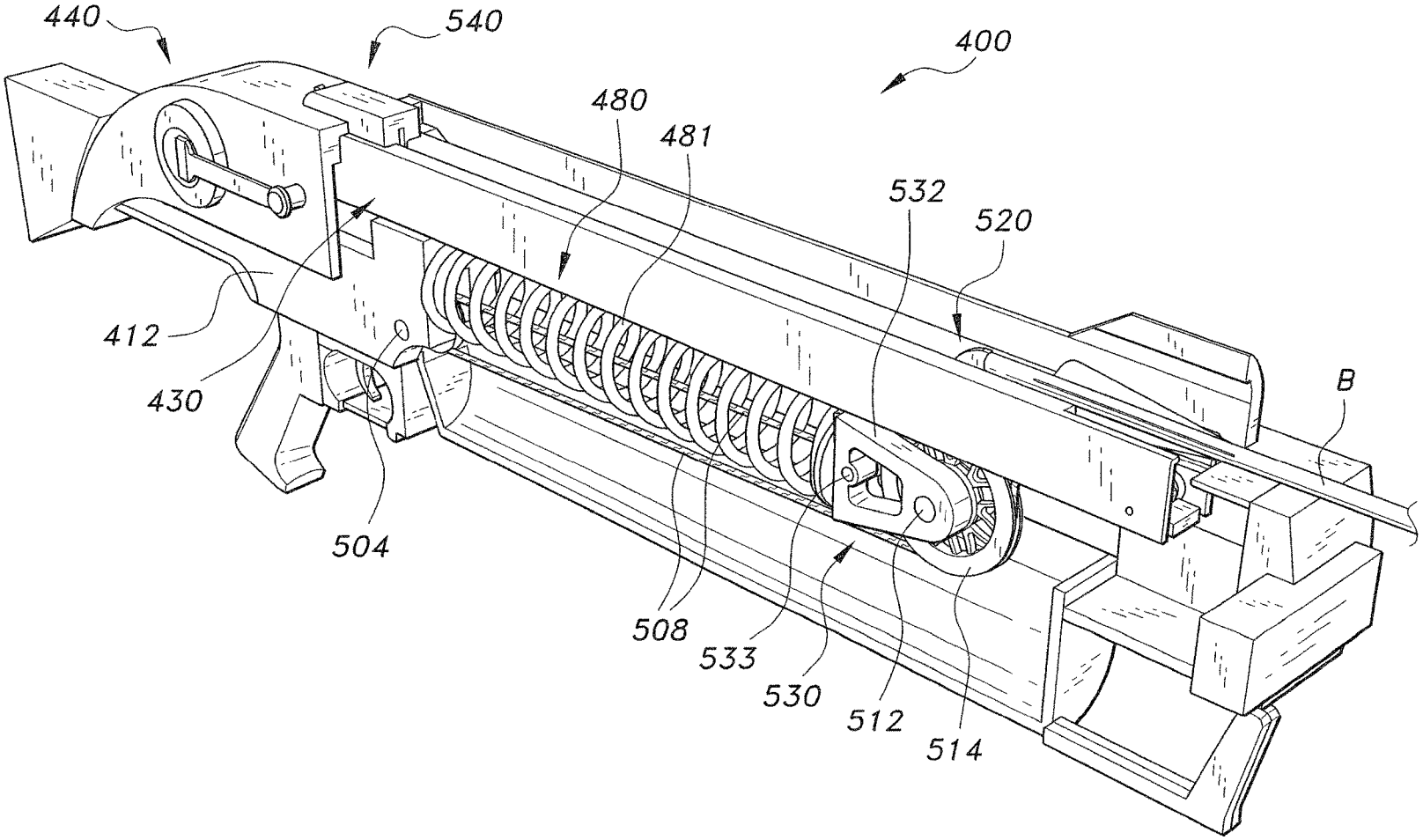
FIG. 11A is a perspective view of a third embodiment of a projectile launcher according to the present invention, shown with part of the side panel removed for clarity.
Figure 11B:
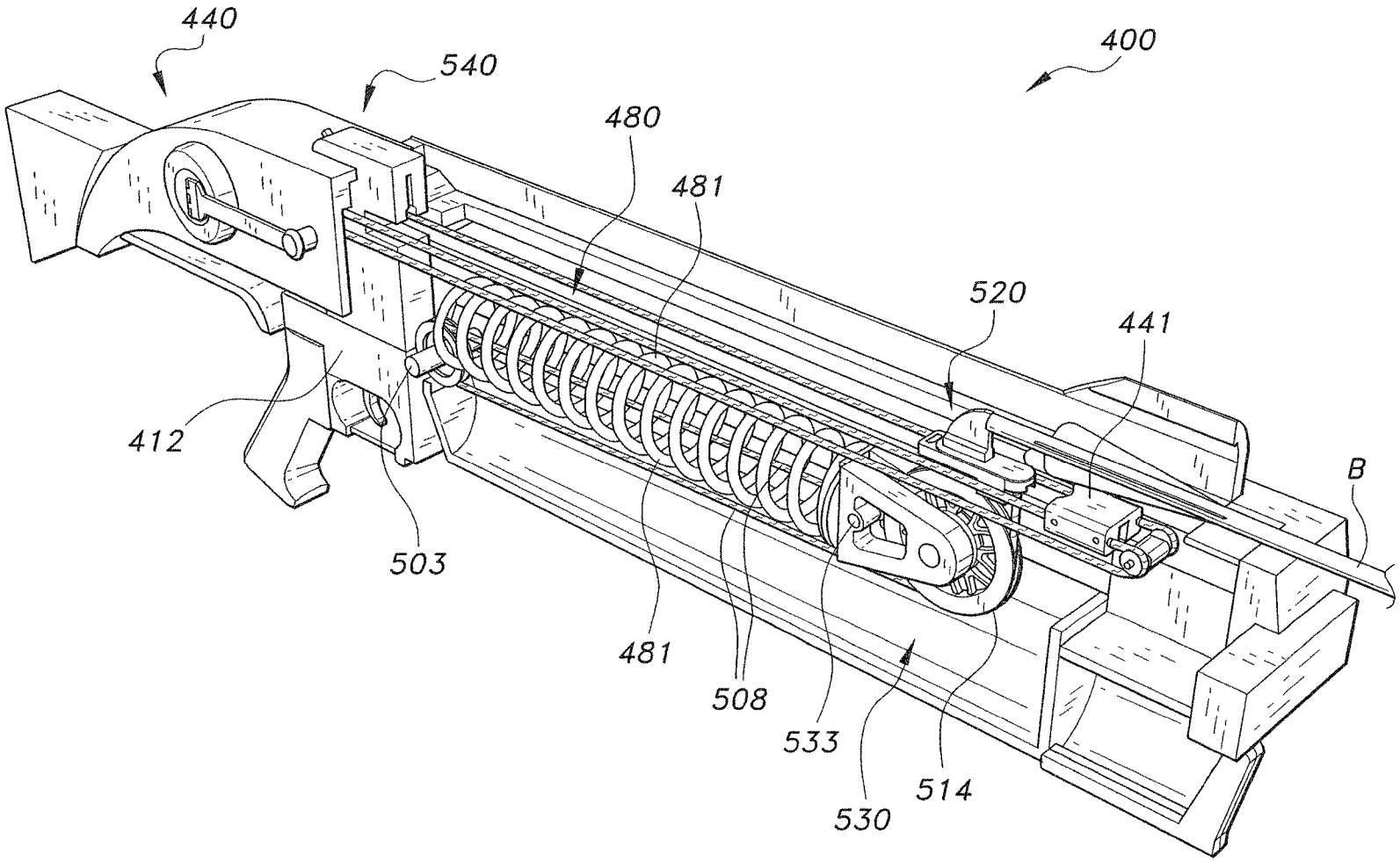
FIG. 11B is a perspective view of the projectile launcher of FIG. 11A, shown with the rail system removed to show additional details.
Figure 12:
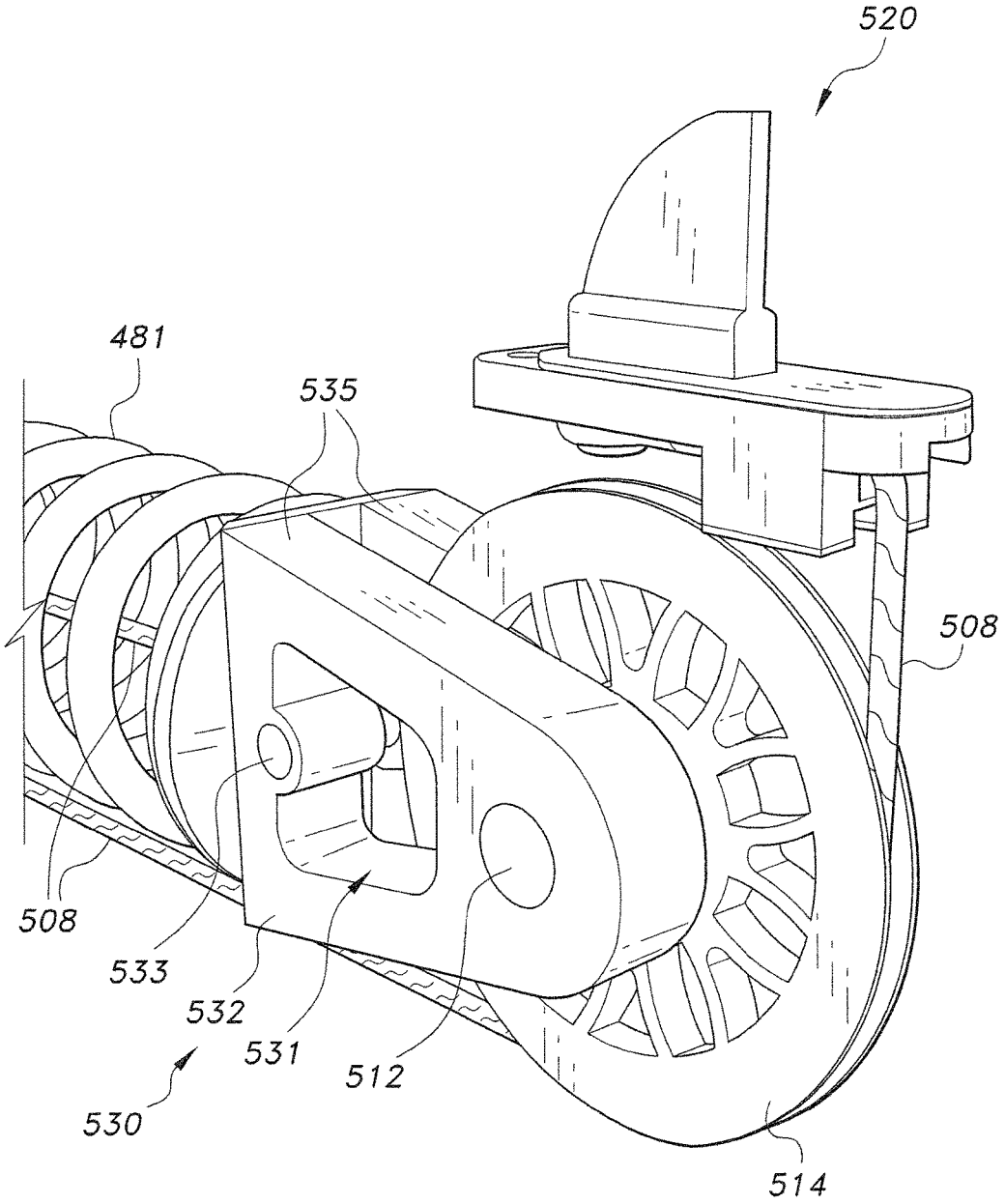
FIG. 12 is a detailed perspective view of a pulley carriage and pulley assembly in the projectile launcher of FIGS. 11A and 11B.

The projectile launcher 400 shown in FIGS. 11A, 11B, and 12 is a further variation of the projectile launcher 200. In this embodiment, the projectile launcher 400 includes a rail system 430, a projectile nock carriage 520 slidably attached to the rail system 430, a trigger system 540 to selectively hold and release the nock carriage 520, and a cocking mechanism 440. These features are substantially the same as those of the previously described projectile launchers, e.g., projectile launcher 10 and projectile launcher 200.

The projectile launcher 400 also includes a biased propulsion system 480 disposed below the rail system 430. The biased propulsion system 480 includes an elongate coil or compression spring 481 and a freely movable pulley carriage 530 operatively connected thereto. Selective compression of the compression spring 481 during cocking of the projectile launcher 400 stores potential energy, and upon release, transforms the potential energy into kinetic energy to propel a projectile B attached to the nock carriage 520.

Both the compression spring 481 and the pulley carriage 530 are substantially the same construction as the previously described compression spring 281 and cam pulley carriage 330. However, the pulley carriage 530 does not include cam pulleys. Instead, the pulley carriage 530 rotatably supports an inner pulley wheel 514 mounted to a trunnion or shaft 512 between prongs 535 of a carriage body 532. Additionally a support shaft 504 is provided near the bottom corner of the riser 412 and underneath the compression spring 481. A guide pulley 503 is rotatably mounted to the support shaft 504.

To compress the compression spring 481, the biased propulsion system 480 also includes a flex cable 508 operatively connected to the inner pulley wheel 514, the guide pulley 503, and the nock carriage 520. One end of the flex cable 508 is anchored to a rear end of the carriage body 532. An anchor shaft or post 533 extends between cutouts 531 of the prongs 535 for the end of the flex cable 508 to anchor thereon. The flex cable 508 extends from the anchor post 533 through the general center of the compression spring 481 and trains around the idler pulley 503. The flex cable 508 loops back from the idler pulley 503 to train around the inner pulley wheel 514. The flex cable 508 continues upward to anchor on the projectile nock carriage 520. Thus, the flex cable 508 forms a continuous loop interconnecting the idler pulley 503, the inner pulley wheel 514, and the nock carriage 520. The flex cable 508 is preferably of a fixed length that places tension on the flex cable 508 when anchored. Also, residual compression of the compression spring 481 when uncocked keeps the flex cable 508 taut so that it doesn't come off the pulleys.

In use, as the nock carriage 520 is pushed towards the trigger system 540 by selective movement of the cocking carriage 441 of the cocking mechanism 440, the nock carriage 520 pulls on the flex cable 508. The engagement of the flex cable 508 with the inner pulley wheel 514 causes the inner pulley wheel 514 to rotate (counterclockwise in the view shown in FIGS. 11A, 11B, and 12), and due to one end of the flex cable 508 being anchored to the pulley carriage 530, also pulls the pulley carriage 530 in the same direction as the nock carriage 520, thereby compressing the compression spring 481. The compression continues until the nock carriage 520 is latched in the cocked position by the trigger system 440.

When the projectile launcher 400 is fired or loosed, the nock carriage 520 rapidly traverses the rail system 430 due to the pulley carriage 530 being pushed by the compression spring 481. As the nock carriage 520 travels past the normal uncocked position, the nock carriage 520 rapidly decelerates in substantially the same manner as with the projectile launcher 200. In this instance, the fixed length of the flex cable 508 places a constantly increasing downward force on the nock carriage 520 the farther the nock carriage 520 travels past the uncocked position.

The arrangement of the inner pulley wheel 514, the idler pulley 503, and the flex cable 508 trained thereon also provides a mechanical advantage in much the same manner as a "gun tackle" pulley system, except configured as a rove to advantage variant. In this instance, the flex cable 508 is trained so that the flex cable 508 is attached to the moving pulley wheel 514 and the flex cable 508 is pulled in substantially the same direction as the direction of compression, where the weight is construed as the force required to further compress the compression spring 481 from a pre-compressed state. This arrangement provides about 3:1 mechanical advantage. Thus, the user needs to exert about one-third of the force via the cocking mechanism 440 to facilitate compression of the compression spring 481. That results in a powerful yet lightweight projectile launcher 400. Moreover, since only a single pulley wheel is included in the pulley carriage 530, the construction of the projectile launcher 400 is less complex, easier to assemble, and lightweight.

As with the projectile launcher 200, the projectile launcher 400 has been constructed so that the angular disposition of the flex cable 508 extending between the nock carriage 520 and the inner pulley wheel 514 and the angular disposition of the flex cable 508 between the idler pulley 503 and the inner pulley wheel 514 with respect to the horizontal are not equal when the nock carriage 520 is in the cocked position. The angular disposition of the portion of the flex cable 508 between the idler pulley 503 and the inner pulley wheel 514 is maintained by the location of the idler pulley 503. The different angular dispositions results in equal vertical component forces that balance out to ensure a linear horizontal stroke of the compression spring 581 when fired. This is another type of dynamic balance mechanism for use with this propulsion system 480.

It is to be understood that the projectile launcher 10, 200, 400 encompasses a variety of alternatives. For example, the projectile launcher 10, 200, 400 can be constructed from a variety of durable materials, such as wood, plastic, metal, composites and combinations thereof. Additionally, the upper and lower rail sections 32, 34 may be separate but integral components, or both can be constructed as a single, unitary structure. The rail sections 32, 34 can also be provided in various shapes, so long as they can support the cocking operation. The cocking carriage can also be dimensioned and configured accordingly to accommodate differently shaped rail sections 32, 34. Alternative gearing arrangements can be constructed for transferring the rotating crank motion into corresponding winding and reeling motion in the cocking mechanism 40. For example, the transmission gear assembly 70 and bevel gear 67 can alternatively be replaced by a simple gear fixed to the crank 64 and used in combination with a ratchet mechanism. Furthermore, various moving parts can be provided with or constructed from friction-reducing material. The projectile launcher 10, 200, 400 is capable of firing various types of elongate projectiles. Other types of projectiles, such as pellets, balls, discs and the like, can also be used with appropriate modifications to the nock carriage and/or the rail system to accommodate the shape.

It is to be understood that the present invention is not limited to the embodiments described above, but encompasses any and all embodiments within the scope of the following claims.

I claim:

1. A projectile launcher, comprising:

a riser base having a top, a bottom, and a front;

a barrel assembly attached to the riser base, the barrel assembly having an elongate rail system adapted for placement of a projectile;

a projectile nock carriage slidably engaged within the rail system, the projectile nock carriage being adapted for supporting the back of the projectile for selective release thereof;

a cocking mechanism attached to the rail system, the cocking mechanism having a cocking carriage selectively engageable with the projectile nock carriage to cock the projectile nock carriage into a cocked position;

a propulsion system coupled to the riser base, the propulsion system storing potential energy during cocking of the projectile nock carriage into the cocked position, the propulsion system releasing the potential energy as kinetic energy accelerating the projectile nock carriage when the projectile nock carriage is released from the cocked position in order to fire the projectile;

a crank mechanism attached to the rail system, the crank mechanism selectively reciprocating the cocking carriage; and a trigger assembly attached to the riser base, the trigger assembly selectively catching and releasing the projectile nock carriage.

2. The projectile launcher according to claim 1, wherein said rail system comprises an elongate upper rail section and an elongate lower rail section, the upper rail section having an elongate vertical slot defined therein for placement of the projectile and passage of at least a portion of said projectile nock carriage, the lower rail section having an elongate horizontal slot defined therein contiguous with the vertical slot and forming a channel, said cocking carriage being slidably mounted in the channel.

3. The projectile launcher according to claim 2, wherein said crank mechanism comprises:

a crank housing attached to the back of said rail system;

a crank rotatably mounted on the crank housing, the crank having a gear inside the crank housing;

an elongate crank arm having a first end pivotally attached to the crank and an opposite second end;

a handle attached to the second end of the crank arm, the handle extending orthogonal to the crank arm, the crank arm being pivotal between an extended position for rotating the crank and a folded position for storage, the handle being receivable in a hole on a side of said barrel assembly for securing the handle; and at least one transmission gear assembly rotatably attached to the back of said rail system, the at least one transmission gear assembly rotating in response to rotation of the gear on the crank.

4. The projectile launcher according to claim 3, wherein said cocking mechanism comprises:

an upper pulley assembly rotatably mounted inside said crank housing;

a lower pulley assembly rotatably mounted inside said crank housing, the upper pulley assembly being operatively connected to one side of said transmission gear assembly, the lower pulley assembly being operatively connected to another side of said transmission gear assembly, rotation of said transmission gear assembly rotating the upper pulley assembly and the lower pulley assembly in opposite directions; and at least one elongate cocking cable attached to said cocking carriage, the at least one cocking cable being anchored to the upper pulley assembly at one end and the other end of the cocking cable being anchored to the lower pulley assembly;

wherein rotation of said transmission gear assembly simultaneously winds and unwinds the at least one cocking cable, facilitating reciprocation of said cocking carriage.

5. The projectile launcher according to claim 4, wherein said cocking carriage comprises:

an elongate, substantially rectangular block having an elongate cable channel extending along the length of the rectangular block to facilitate free passage of a cable attached to said projectile nock carriage;

an arcuate engagement notch formed on one end of the rectangular block, the engagement notch selectively engaging a front of said projectile nock carriage during a cocking operation;

a pair of spaced cocking cable grooves extending between opposite ends of the rectangular block, said at least one cocking cable being mounted inside each of the cable grooves; and a plurality of anchor pins, each of the pins extending into a corresponding one of the cable grooves to keep said at least one cocking cable mounted therein, thereby fixing relative position of said cocking carriage along the length of said at least one cocking cable.

6. The projectile launcher according to claim 2, wherein said projectile nock carriage comprises:

an elongate base having a substantially oblong shape, a front end, a back end, and a width, the width being configured to slidably fit inside the horizontal slot of said lower rail section, the front end being rounded to self-adjust and seat against said cocking carriage during a cocking operation, and the back end having a trigger catch slot defined therein for selective engagement by said trigger assembly in a fully cocked position;

a pair of spaced leg members extending downward from the base to define relative height of said projectile nock carriage within said horizontal slot;

an elongate cable groove extending from the front end towards the back end;

a flex cable;

a cable support web extending between the leg members, the cable support web defining a closed channel for passage of the flex cable therethrough;

an anchor post extending downward near the back end to secure one end of the flex cable, the flex cable being threaded through the cable groove and anchored onto the anchor post; and a nock fin extending vertically from the base, the nock fin being adapted to ride inside the vertical slot of said upper rail section and selectively engage a back end of the projectile for subsequent firing of the projectile.

7. The projectile launcher according to claim 6, further comprising a wear plate attached to the bottom of each said leg member.

8. The projectile launcher according to claim 6, wherein at least one surface of said projectile nock carriage comprises a friction-reducing material.

9. The projectile launcher according to claim 1, wherein said propulsion mechanism comprises a bow assembly attached to said riser base, the bow assembly being oriented reversed and vertically, the bow assembly having at least one flex cable trained on said projectile nock carriage, the bow assembly being flexed when the projectile nock carriage is moved to said cocked position.

10. The projectile launcher according to claim 9, wherein said bow assembly comprises:

an elongate, resiliently flexible upper bow arm attached to the top of said riser base, the upper bow arm having a wide section and a narrow section continuous with the wide section, the flexible upper bow arm being a forked limb having a pair of spaced prongs;

an elongate, resiliently flexible lower bow arm attached to the bottom of said riser base, the lower bow arm having a wide section, a narrow section continuous with the wide section, and a cam pulley assembly attached to the narrow section thereof, the flexible lower bow arm being a forked limb having a pair of spaced prongs;

Wherein said at least one flex cable comprises at least one first flex cable trained between the flexible upper bow arm and the cam pulley assembly; and Wherein said at least one flex cable comprises at least one second flex cable trained between the cam pulley assembly and said projectile nock carriage;

wherein movement of said projectile nock carriage towards the cocked position pulls the at least one second flex cable, thereby rotating the cam pulley assembly and winding the at least one first flex cable, causing the upper bow arm and the lower bow arm to flex toward each other.

11. The projectile launcher according to claim 10, wherein said cam pulley assembly comprises:

A guide roller mounted between prong ends of said flexible upper bow arm;

An anchor stub extending outward from an outer side of each of the prong ends of said flexible upper bow arm;

A rotatable shaft extending between the prong ends of said flexible lower bow arms;

An inner pulley wheel mounted to the rotatable shaft between the prong ends of said flexible lower bow arms; and a pair of cam pulley wheels mounted to opposite ends of the rotatable shaft, said at least one first flex cable having one end anchored to a corresponding anchor stub and an opposite end anchored to a corresponding cam pulley wheel, said at least one second flex cable having one end anchored to the inner pulley wheel and an opposite end trained around the guide roller to anchor onto said projectile nock carriage.

12. The projectile launcher according to claim 1, where said propulsion mechanism comprises:

an elongate compression spring disposed below said rail system, the compression spring having a flat surface at opposite ends, the compression spring having a first end abutting the front of said riser base;

a pulley carriage; the compression spring having a second end abutting the pulley carriage, the pulley carriage having a forked body forming a pair of carriage prongs extending towards one end and a flat surface at the other end of the pulley carriage, the flat surface of the pulley carriage abutting the second end of the compression spring;

a pulley assembly mounted to the carriage prongs; and at least one flex cable attached to the pulley assembly and said projectile nock carriage;

wherein movement of said projectile nock carriage towards the cocked position pulls the at least one flex cable, thereby moving the pulley carriage to compress the compression spring.

13. The projectile launcher according to claim 12, wherein said pulley assembly comprises:

a rotatable support shaft mounted through ends of said carriage prongs;

an inner pulley wheel mounted to the support shaft between said carriage prongs; and a pair of spaced outer cam pulley wheels mounted to opposite ends of the support shaft to cap the opposite ends.

14. The projectile launcher according to claim 13, the projectile launcher having an anchor stub mounted to each lateral side of said riser below said compression spring, wherein said at least one flex cable comprises:

at least one first flex cable having one end anchored to a corresponding anchor stub and an opposite end anchored to a corresponding cam pulley wheel; and at least one second flex cable having a first end anchored to said inner pulley wheel and an opposite second end anchored to said projectile nock carriage;

wherein cocking of said projectile nock carriage pulls the at least one second cable to rotate said inner pulley wheel and unwind the at least one second flex cable, rotation of said inner pulley wheel simultaneously rotating said outer cam pulley wheels to wind the at least one first cable on each said outer cam pulley wheel, resulting in compression of said compression spring.

15. The projectile launcher according to claim 12, wherein said pulley assembly comprises:

a rotatable support shaft mounted through ends of said carriage prongs;

an inner pulley wheel mounted to the support shaft between said carriage prongs;

an anchor post mounted to a rear end of said pulley carriage;

a support shaft mounted to a bottom corner of said riser below said compression spring; and a guide pulley rotatably mounted to the support shaft on said riser.

16. The projectile launcher according to claim 15, wherein said at least one flex cable has one end anchored to said anchor post on said pulley carriage, said at least one flex cable extending through said compression spring and training around said guide pulley and said inner pulley wheel, said at least one flex cable being anchored to said projectile nock carriage, wherein cocking of said projectile nock carriage pulls said at least one flex cable to rotate said inner pulley wheel and simultaneously move said pulley carriage towards said riser, thereby resulting in compression of said compression spring.

17. The projectile launcher according to claim 12, wherein said forked body is substantially wedge-shaped.

18. The projectile launcher according to claim 1, wherein said trigger assembly comprises a grip, a trigger adjacent the grip, and at least one catch for selectively engaging said projectile nock carriage, the trigger releasing the at least one catch when pulled.

* * * * *